US010286699B2

(12) United States Patent
Kawarada et al.

(10) Patent No.: US 10,286,699 B2
(45) Date of Patent: May 14, 2019

(54) IMAGING DEVICE, IMAGE FORMING APPARATUS, AND METHOD FOR DETECTING DEVIATION OF LANDING POSITION

(71) Applicants: Masaya Kawarada, Kanagawa (JP); Nobuyuki Satoh, Kanagawa (JP); Suguru Yokozawa, Kanagawa (JP); Kohta Aoyagi, Kanagawa (JP); Kenta Sasaki, Kanagawa (JP)

(72) Inventors: Masaya Kawarada, Kanagawa (JP); Nobuyuki Satoh, Kanagawa (JP); Suguru Yokozawa, Kanagawa (JP); Kohta Aoyagi, Kanagawa (JP); Kenta Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/818,671

(22) Filed: Nov. 20, 2017

(65) Prior Publication Data

US 2018/0141359 A1 May 24, 2018

(30) Foreign Application Priority Data

Nov. 22, 2016 (JP) ..... 2016-227170
Oct. 26, 2017 (JP) ..... 2017-207344

(51) Int. Cl.
*B41J 2/21* (2006.01)
*B41J 11/46* (2006.01)
(Continued)

(52) U.S. Cl.
CPC ..... *B41J 29/393* (2013.01); *B41J 2/0458* (2013.01); *B41J 2/04505* (2013.01);
(Continued)

(58) Field of Classification Search
CPC ..... B41J 29/393; B41J 19/145; B41J 11/46; B41J 2/2135; B41J 2/04505; B41J 2029/3935; B41J 2/04558; B41J 2/04573
See application file for complete search history.

(56) References Cited

U.S. PATENT DOCUMENTS

2009/0316164 A1 12/2009 Takahashi et al.
2011/0205275 A1 8/2011 Kimura et al.
(Continued)

FOREIGN PATENT DOCUMENTS

JP 2011-161718 8/2011
JP 2012-187913 10/2012
JP 2016-221719 12/2016

OTHER PUBLICATIONS

European Search Report; 17202823.5-1019; dated Mar. 28, 2018.

*Primary Examiner* — Julian D Huffman
(74) *Attorney, Agent, or Firm* — Duft & Bornsen, PC

(57) ABSTRACT

An imaging device includes an imaging unit to obtain a captured image of a test pattern and a reference mark to locate the test pattern and at least one processor. The test pattern includes a pair of first marks and a second mark. The processor includes a position detector configured to detect the reference mark in the captured image and locate the pair of first marks and the second mark in the captured image, and a ratio calculator configured to calculate one of a first ratio between a distance between the pair of first marks in the captured image and a deviation of the second mark in the captured image, and a second ratio between the distance between the pair of first marks in the captured image and a distance from one of the pair of first marks to the second mark in the captured image.

10 Claims, 25 Drawing Sheets

(51) Int. Cl.

| | |
|---|---|
| ***B41J 19/14*** | (2006.01) |
| ***B41J 2/045*** | (2006.01) |
| ***B41J 29/13*** | (2006.01) |
| ***B41J 29/393*** | (2006.01) |

(52) U.S. Cl.
CPC ..... *B41J 2/04581* (2013.01); *B41J 2/2135* (2013.01); *B41J 11/46* (2013.01); *B41J 19/145* (2013.01); *B41J 29/13* (2013.01); *B41J 2029/3935* (2013.01)

(56) References Cited

U.S. PATENT DOCUMENTS

| | | | | |
|---|---|---|---|---|
| 2012/0218568 | A1 | 8/2012 | Yorimoto et al. | |
| 2013/0135484 | A1 | 5/2013 | Satoh et al. | |
| 2014/0300722 | A1 | 10/2014 | Garcia | |
| 2016/0347052 | A1* | 12/2016 | Kawarada | B41J 2/04505 |
| 2018/0141329 | A1* | 5/2018 | Aoyagi | B41J 29/02 |
| 2018/0147835 | A1* | 5/2018 | Nakamura | B41J 29/13 |

* cited by examiner

IMAGING DEVICE, IMAGE FORMING APPARATUS, AND METHOD FOR DETECTING DEVIATION OF LANDING POSITION

CROSS-REFERENCE TO RELATED APPLICATIONS

This patent application is based on and claims priority pursuant to 35 U.S.C. § 119(a) to Japanese Patent Application Nos. 2016-227170 filed on Nov. 22, 2016, and 2017-207344 filed on Oct. 26, 2017, in the Japan Patent Office, the entire disclosure of each of which is hereby incorporated by reference herein.

BACKGROUND

Technical Field

This disclosure relates to an imaging device, an image forming apparatus, and a method for detecting a deviation in landing position.

Description of the Related Art

Many inkjet image forming apparatuses discharge ink from a recording head mounted on a carriage, thereby forming an image on a recording medium while moving the carriage forward and backward in a main scanning direction. In such a configuration, even when the image forming apparatus is controlled to discharge ink to an identical position, it is possible that the position at which the ink lands on the recording medium differs between forward travel of the carriage and backward travel of the carriage. This positional deviation is called deviation in ink landing position.

The cause of such deviation in ink landing position is not limited to the difference in travel direction of the carriage that moves forward and backward. The deviation in ink landing position may be caused by, for example, an error in attachment position of the recording head to the carriage. Specifically, in a configuration including a plurality of recording heads for image formation, due to an error in attaching the plurality of recording heads to the carriage, the relative positions between the recording heads differ from the designed relative positions. Then, deviations in ink landing position occur between the recording heads.

In the case of deviation in ink landing position, for example, a parameter relating to a position of image formation by the image forming apparatus is adjusted to resolve the deviation. To adjust the position of image formation, it is known that a predetermined test pattern is formed on a recording medium and the test pattern is read with a sensor (a variety of sensors is usable) to detect the deviation in ink landing position.

SUMMARY

According to an embodiment of this disclosure, an imaging device includes an imaging unit to obtain a captured image of a test pattern and a reference mark to locate the test pattern and at least one processor. The test pattern includes a pair of first marks and a second mark. The processor includes a position detector configured to detect the reference mark in the captured image and locate the pair of first marks and the second mark in the captured image with reference to the reference mark, and a ratio calculator configured to calculate one of a first ratio between a distance between the pair of first marks in the captured image and a deviation of the second mark in the captured image, and a second ratio between the distance between the pair of first marks in the captured image and a distance from one of the pair of first marks to the second mark in the captured image.

According to another embodiment, an image forming apparatus includes an image forming device to form the test pattern and the reference mark, an imaging unit to obtain a captured image including the test pattern and the reference mark, and at least one processor. The processor includes a pattern forming unit configured to cause the image forming device to form the pair of first marks under a first condition, form a second mark under a second condition different from the first condition, and form the reference mark together with one of the pair of first marks and the second mark. The processor further includes a position detector configured to detect the reference mark in the captured image and locate the pair of first marks and the second mark in the captured image. The processor further includes a distance calculator configured to calculate an actual distance of a deviation of the second mark, based on a distance between the pair of first marks in the captured image, a position of the second mark in the captured image, and a theoretical distance between the pair of first marks.

Another embodiment provides a method including obtaining a captured image of a test pattern and a reference mark to locate the test pattern, the test pattern including a pair of first marks and a second mark, detecting the reference mark in the captured image, locating the pair of first marks and the second mark in the captured image, and calculating one of a first ratio between a distance between the pair of first marks in the captured image and a deviation of the second mark in the captured image, and a second ratio between the distance between the pair of first marks in the captured image and a distance from one of the pair of first marks to the second mark in the captured image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
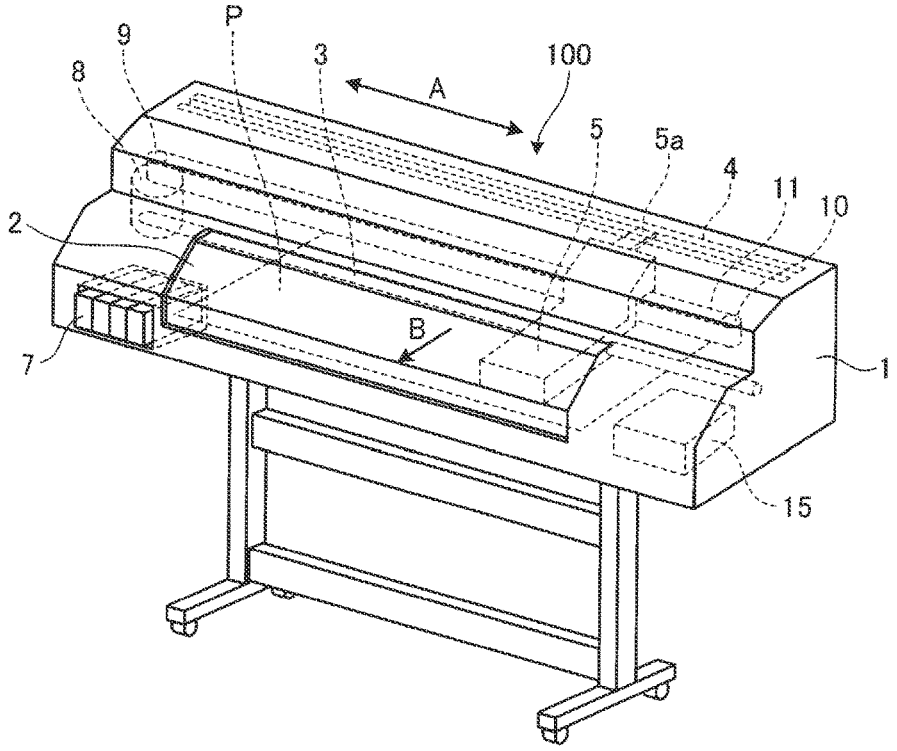
FIG. 1 is a perspective view of an interior of an image forming apparatus according to Embodiment 1.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an imaging device, an image forming apparatus, a method for calculating an actual distance of deviation, and a program to cause a processor to perform the method according to embodiments of this disclosure will be described. As used herein, the singular forms "a", "an", and "the" are intended to include the plural forms as well, unless the context clearly indicates otherwise.

The suffixes y, m, c, and k attached to reference numerals indicate only that components indicated thereby are used for forming yellow, magenta, cyan, and black images, respectively.

Note that an inkjet printer configured to discharge ink on a recording medium (an example of the conveyed object) to form an image will be described as an example image forming apparatus in the embodiments described below. The image forming apparatus has a function of capturing an image of a test pattern on a recording medium, using the captured image to calculate a distance corresponding to the amount of deviation of the landing position of ink when the deviation of the landing position occurs, and adjusting the parameter relating to image formation. That is, the image forming apparatus according an aspect of this disclosure functions as an imaging device. However, examples to which aspect of this disclosure are applicable are not limited to the embodiments described below. Aspects of present disclosure can be widely applied to various types of image forming apparatuses configured to capture an image of a test pattern in order to calculate the distance corresponding to the amount of deviation using the captured image.

Embodiment 1

[Mechanical Configuration of Image Forming Apparatus]

Figure 2:
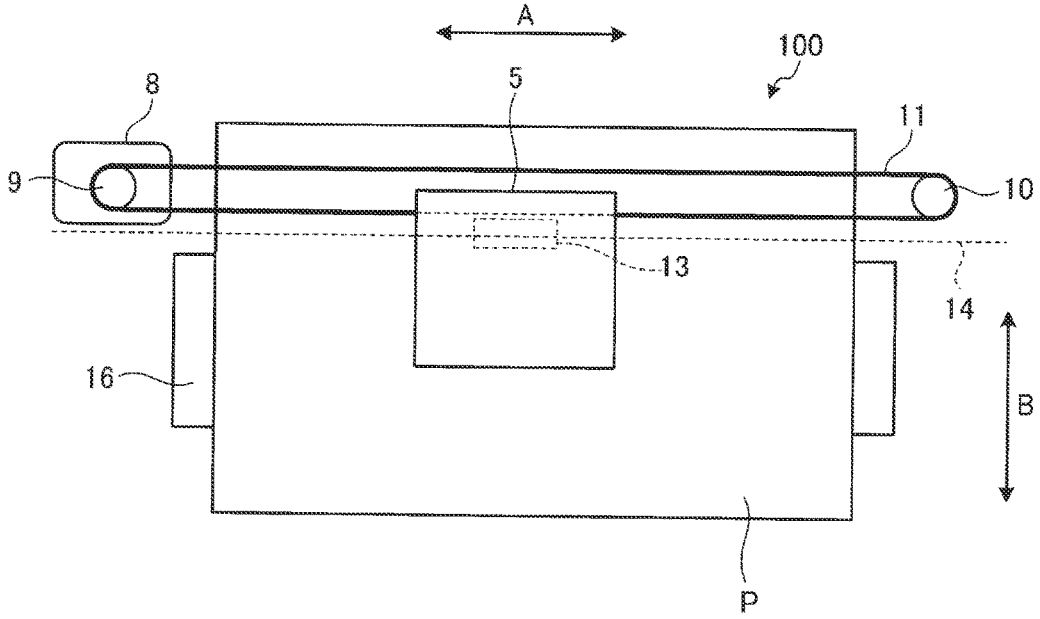
FIG. 2 is a top view of a mechanical configuration of the image forming apparatus according to Embodiment 1.
Figure 3:
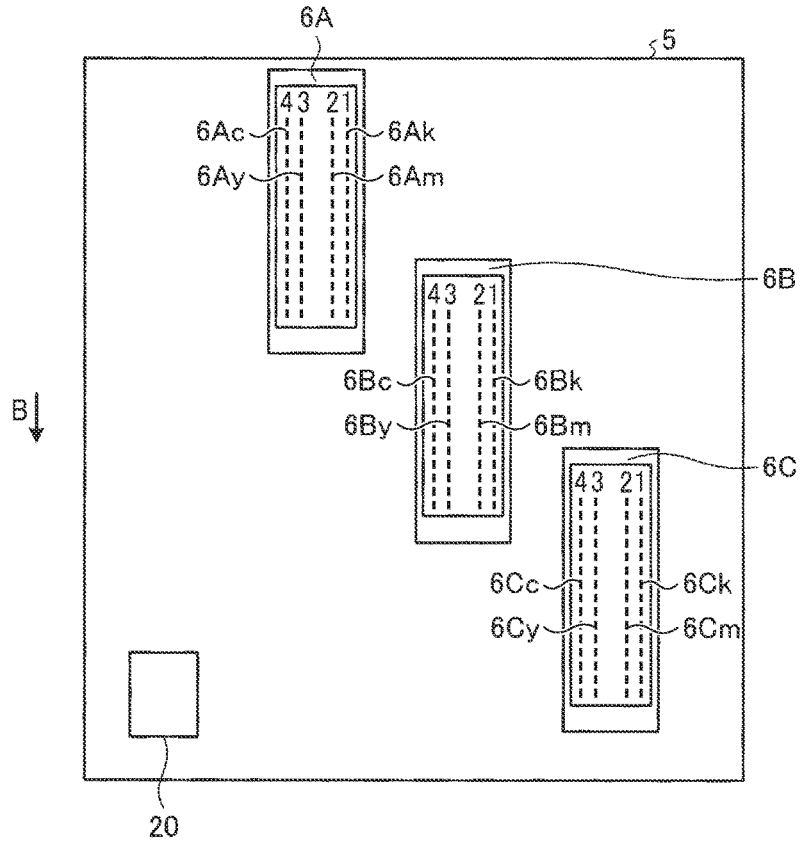
FIG. 3 is a view of a carriage according to Embodiment 1.

An exemplary mechanical configuration of an image forming apparatus 100 will be described first referring to the appended drawings. FIG. 1 is a perspective view of the inside of the image forming apparatus according to Embodiment 1. FIG. 2 is a top view illustrating the mechanical structure inside the image forming apparatus according to Embodiment 1. FIG. 3 is a view of a carriage of the image forming apparatus illustrated in FIG. 1.

As illustrated in FIG. 1, the image forming apparatus 100 according to the present embodiment includes a carriage 5 to reciprocate in a main scanning direction indicated by arrow A (hereinafter referred to as "main scanning direction A"). The carriage 5 is supported by a main guide rod 3 extending in the main scanning direction A. In addition, the carriage 5 includes a coupler 5*a*. The coupler 5*a* engages with a sub guide 4 disposed parallel to the main guide rod 3 to stabilize the posture of the carriage 5.

The carriage 5 is coupled to a timing belt 11 extending between a driving pulley 9 and a driven pulley 10. The driving pulley 9 rotates by the driving of the main scanning motor 8. The driven pulley 10 includes a mechanism to adjust the distance with the driving pulley 9 in order to give a predetermined degree of tension to the timing belt 11. As the main scanning motor 8 drives the timing belt 11, the carriage 5 reciprocates in the main scanning direction A. For example, an encoder sensor 13 is disposed on the carriage 5 as illustrated in FIG. 2. The encoder sensor 13 detects a mark on an encoder sheet 14 and outputs an encoder value. The amount and speed of travel of the carriage 5 are controlled based on the encoder value.

The carriage 5 includes recording heads 6A, 6B, and 6C as illustrated in FIG. 3. The recording head 6A includes a nozzle line 6Ay in which many nozzles to discharge yellow (Y) ink are arranged, a nozzle line 6Ac in which many nozzles to discharge cyan (C) ink are arranged, a nozzle line 6Am in which many nozzles to discharge magenta (M) ink are arranged, and a nozzle line 6Ak in which many nozzles to discharge black (K) ink are arranged. Similarly, the recording head 6B includes nozzle lines 6By, 6Bc, 6Bm, and 6Bk. The recording head 6C includes nozzle lines 6Cy, 6Cc, 6Cm, and 6Ck. Hereinafter, the recording heads 6A, 6B, and 6C will collectively be referred to as recording heads 6. The recording head 6 is supported by the carriage 5 so that a discharge face (nozzle face) of the recording head 6 faces down (toward a recording medium P).

A cartridge 7, from which ink is supplied to the recording head 6, is not mounted on the carriage 5. A cartridge 7 is disposed at a predetermined position in the image forming apparatus 100. The cartridge 7 and the recording head 6 are coupled with a pipe so that ink is supplied through the pipe from the cartridge 7 to the recording head 6.

A platen 16 is disposed at a position facing the discharge face of the recording head 6 as illustrated in FIG. 2. The platen 16 is used to support the recording medium P when ink is discharged from the recording head 6 onto the recording medium P. The platen 16 includes many through holes penetrating in the thickness direction and rib-shaped projections surrounding each of the through holes. The platen 16 includes a suction fan on a face opposite to the face supporting the recording medium P. Activating the suction fan prevents the recording medium P from falling from the platen 16. The recording medium P is held between a conveyance roller pair and intermittently conveyed on the platen 16 in a sub-scanning direction indicated by arrow B illustrated in the drawings (hereinafter "sub-scanning direction B" or "direction of conveyance of the recording medium"). The conveyance roller is driven by a sub-scanning motor 12 to be described below (see FIG. 13).

The recording head 6 includes a plurality of nozzles lined up in the sub-scanning direction B as described above. The image forming apparatus 100 according to the present embodiment intermittently conveys the recording medium P in the sub-scanning direction B. Meanwhile, the image forming apparatus 100 causes the carriage 5 to reciprocate in the main scanning direction A, selectively drives the nozzles of the recording head 6 according to the image data, and discharges the ink from the recording head 6 to the recording medium P on the platen 16 while the conveyance of the recording medium P stops in order to record an image on the recording medium P.

The image forming apparatus 100 according to the present embodiment further includes a maintenance mechanism 15 to maintain the reliability of the recording head 6. For example, the maintenance mechanism 15 cleans the discharge face of the recording head 6, puts a cap on the recording head 6, and discharges unnecessary ink from the recording head 6.

As illustrated in FIG. 3, on the carriage 5, an imaging unit 20 (an imaging device) to capture an image of a test pattern TP (see FIG. 15A) on the recording medium P is mounted. The imaging unit 20 will be described in detail later.

Above-described the components of the image forming apparatus 100 according to the present embodiment are disposed in an enclosure 1. The enclosure 1 includes a cover 2 to open and close. When maintenance of the image forming apparatus 100 is performed or when paper jam occurs, the cover 2 is opened, and work relating to the components in the enclosure 1 can be performed.

In an embodiment, the imaging unit 20 illustrated in FIG. 3 includes a reference chart to be simultaneously captured together with the test pattern TP. In another embodiment, the imaging unit 20 does not include such a reference chart. The reference chart is used to calculate the colorimetric value of the test pattern TP, for example, according to the RGB value of each colorimetric patch (see FIG. 9).

[Example 1 of Imaging Unit]

Figure 4:
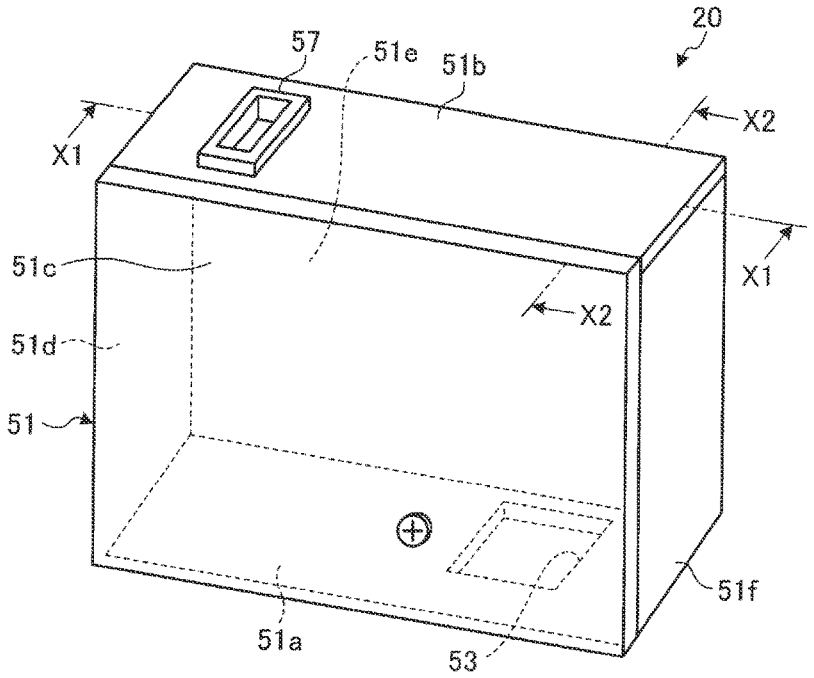
FIG. 4 is a perspective view of an appearance of an imaging unit according to Embodiment 1.
Figure 5:
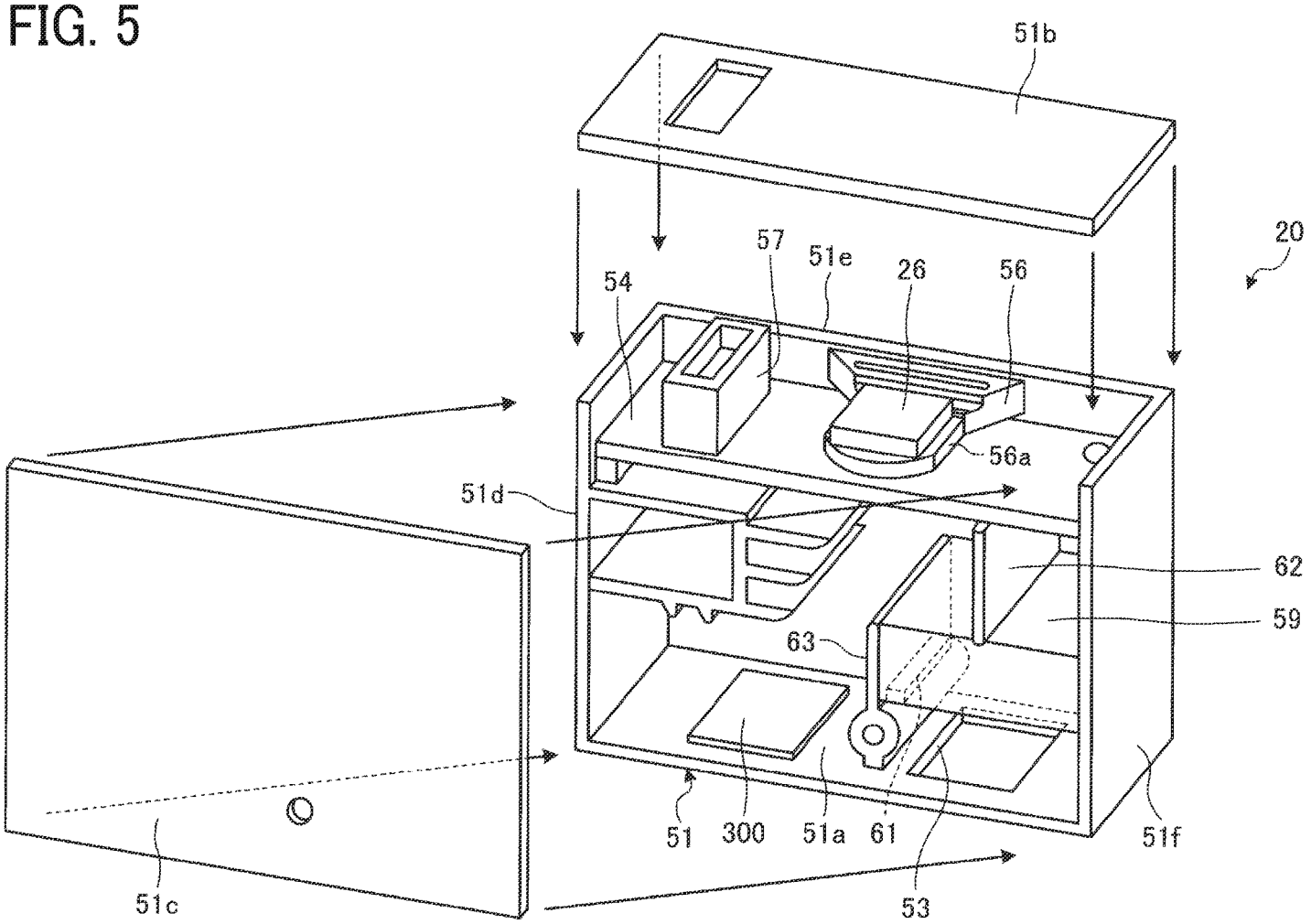
FIG. 5 is an exploded perspective view of the imaging unit illustrated in FIG. 4.
Figure 6:
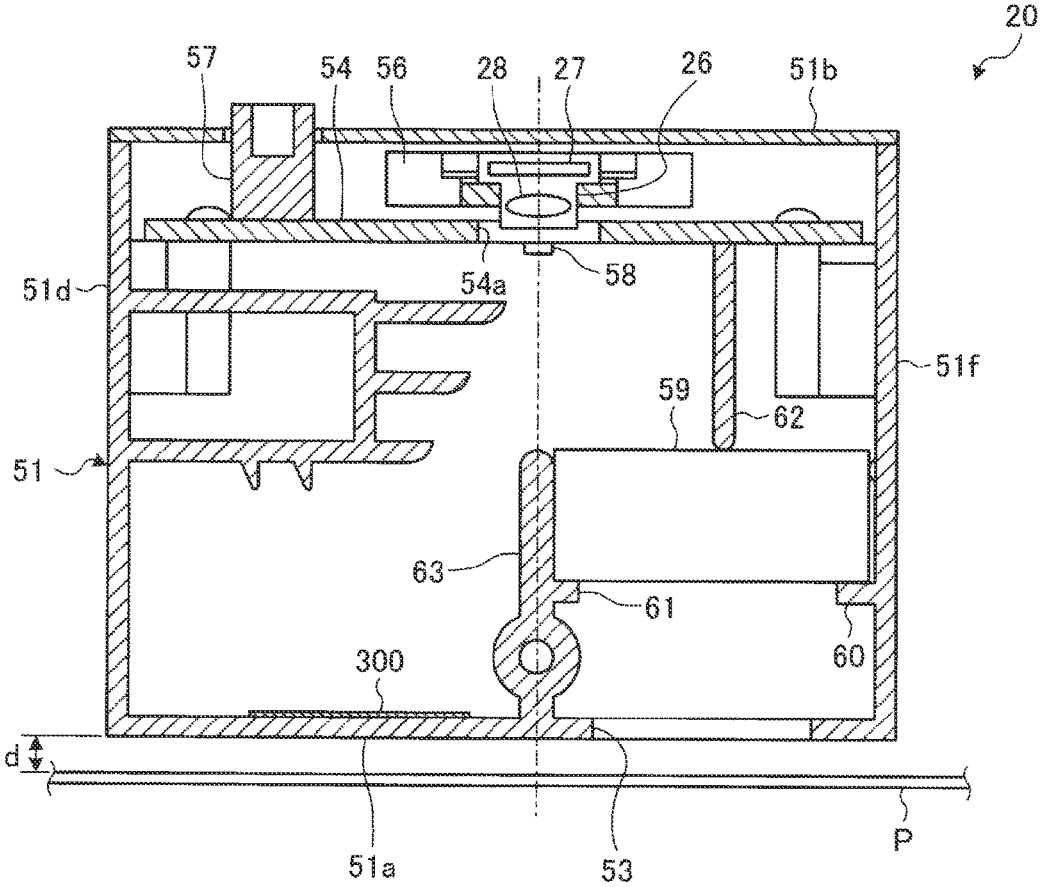
FIG. 6 is a vertical cross-sectional view of the imaging unit, viewed in a direction indicated by arrow X1 in FIG. 4.
Figure 7:
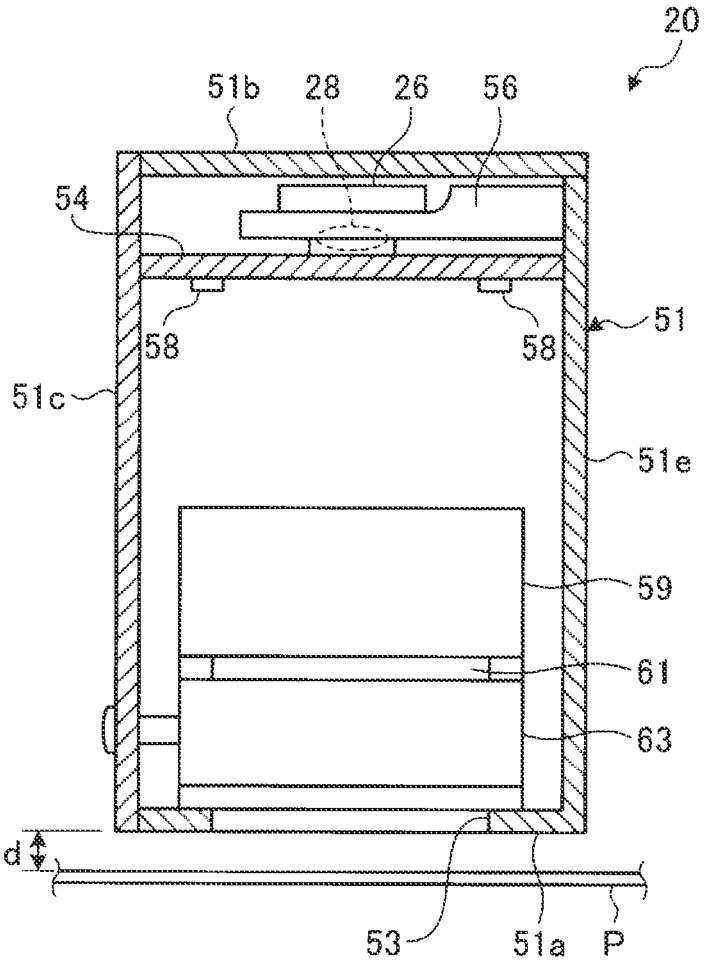
FIG. 7 is a vertical cross-sectional view of the imaging unit, as viewed in a direction indicated by arrow X2 in FIG. 4.
Figure 8:
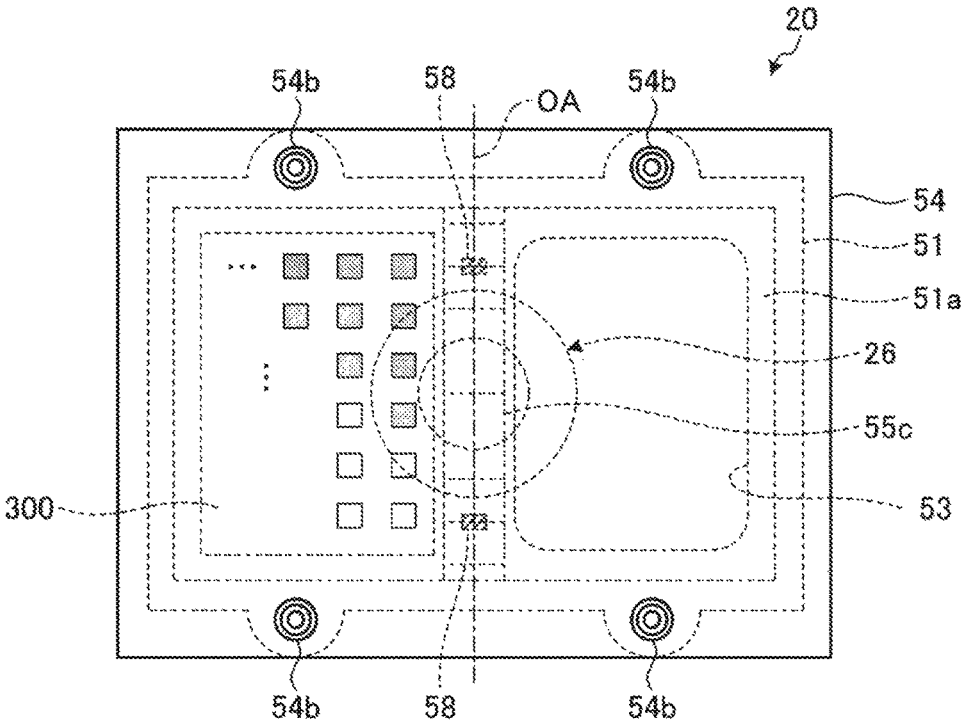
FIG. 8 is a plan view of the imaging unit.

An example in which the imaging unit 20 includes a reference chart will be described first. FIG. 4 is a perspective view of the appearance of the imaging unit 20. FIG. 5 is an exploded perspective view of the imaging unit 20. FIG. 6 is a vertical cross-sectional view of the imaging unit 20, as viewed in the direction indicated by arrow X1 in FIG. 4. FIG. 7 is a vertical cross-sectional view of the imaging unit 20, as viewed in the direction indicated by arrow X2 in FIG. 4. FIG. 8 is a plan view of the imaging unit 20.

The imaging unit 20 includes a housing 51, for example, formed into a rectangular box. The housing 51 includes, for example, a bottom board 51*a*, a top board 51*b*, and sidewalls 51*c*, 51*d*, 51*e*, and 51*f*. The bottom board 51*a* and top board 51*b* face each other and at a predetermined interval from each other. The sidewalls 51*c*, 51*d*, 51*e*, and 51*f* couple the bottom board 51*a* to the top board 51*b*. The bottom board 51*a* and the sidewalls 51*d*, 51*e*, and 51*f* of the housing 51 are formed as a single piece by, for example, molding. The top board 51*b* and the sidewall 51*c* are detachably attached thereto. FIG. 5 illustrates the state in which the top board 51*b* and the sidewall 51*c* are detached.

For example, the imaging unit 20 is disposed on a conveyance passage in a state in which a portion of the housing 51 is supported by a predetermined support. The recording medium P on which the test pattern TP is formed is conveyed on the conveyance passage. Meanwhile, the imaging unit 20 is supported by the predetermined support so that the bottom board 51*a* of the housing 51 faces the conveyed recording medium P approximately in parallel with a gap d secured therebetween, as illustrated in FIGS. 6 and 7.

The bottom board 51*a* of the housing 51 facing the recording medium P on which the test pattern TP is formed includes an opening 53 that enables the imaging unit 20 to capture an image of the test pattern TP outside the housing 51 from the inside of the housing 51.

In addition, the housing 51 includes a reference chart 300 on an inner face of the bottom board 51*a*. The reference chart 300 is disposed next to the opening 53 via the supporting member 63. A sensor unit 26, which is described later, captures an image of the reference chart 300 together with an image of the test pattern TP for colorimetry of the test pattern TP and obtains the RGB (red green blue) values. The reference chart 300 will be described in detail later.

Meanwhile, a circuit board 54 is disposed near the top board 51*b* in the housing 51. As illustrated in FIG. 8, the housing 51 is secured to the circuit board 54 by a securing member 54*b*, and the housing 51 is shaped like a rectangular box that is open on the side of the circuit board 54. Note that the shape of the housing 51 is not limited to a rectangular box but can be a cylindrical or elliptical box including the bottom board 51*a* having the opening 53.

The housing 51 further includes the sensor unit 26 disposed between the top board 51*b* and the circuit board 54 and configured to capture an image. The sensor unit 26 includes a two-dimensional sensor 27 and an imaging lens 28 as illustrated in FIG. 6. The two-dimensional sensor 27 is, for example, a Charge Coupled Device (CCD) sensor or a Complementary Metal Oxide Semiconductor (CMOS) sensor. The imaging lens 28 forms an optical image in a capture range of the sensor unit 26 on a light-receiving face (imaging region) of the two-dimensional sensor 27. The two-dimensional sensor 27 is a light-receiving element array including two-dimensionally arranged arrays of light-receiving elements to receive the light reflected from the object to be captured (i.e., a captured object).

The sensor unit 26 is held, for example, by a sensor holder 56 integrally formed with the sidewall 51*e* of the housing 51. The sensor holder 56 includes a ring 56*a* disposed at a position facing the through hole 54*a* on the circuit board 54. The ring 56*a* includes a through hole having a size corresponding to the external shape of a protruding portion of the sensor unit 26 including the imaging lens 28. In the sensor unit 26, as the protruding portion including the imaging lens 28 is inserted into the ring 56*a* of the sensor holder 56, the sensor holder 56 holds the imaging lens 28 so that the imaging lens 28 faces the bottom board 51*a* of the housing 51 through the through hole 54*a* of the circuit board 54.

At that time, as the sensor unit 26 is positioned and held by the sensor holder 56, an optical axis illustrated as an alternate long and short dash line in FIG. 6 is approximately perpendicular to the bottom board 51*a* of the housing 51, and the opening 53 and the reference chart 300 are included in the image capture range. With this structure, with a portion of the imaging region of the two-dimensional sensor 27, the sensor unit 26 captures an image of the test pattern TP outside the housing 51, through the opening 53. In addition, with another portion of the imaging region of the two-dimensional sensor 27, the sensor unit 26 can capture an image of the reference chart 300 in the housing 51.

Note that the sensor unit 26 is electrically coupled to the circuit board 54 mounting various electronic components, for example, via a flexible cable. The circuit board 54 further includes an external coupling connector 57 including a coupling cable to couple the imaging unit 20 to a main control board of the image forming apparatus 100.

The imaging unit 20 includes a pair of light sources 58 disposed on the circuit board 54, on a central line OA passing through the center of the sensor unit 26 in the sub-scanning direction B. The light sources 58 are equally away from the center of the sensor unit 26 in the sub-scanning direction B. The light sources 58 approximately evenly illuminate the range captured by the sensor unit 26. The light source 58 is, for example, a light emitting diode (LED) that effectively saves space and power.

In the present embodiment, the pair of LEDs is used as the light sources 58, and the LEDs are equally arranged with respect to the center of the imaging lens 28 in a direction perpendicular to a direction in which the opening 53 and the reference chart 300 are arranged as illustrated in FIGS. 7 and 8.

The two LEDs used as the light sources 58 are mounted, for example, on a face of the circuit board 54 facing the bottom board 51*a*. However, the light source 58 can be disposed at any position at which the diffusion light can approximately evenly illuminate the range captured by the sensor unit 26. Thus, the light source 58 is not necessarily mounted on the circuit board 54 directly. In addition, placing the two LEDs symmetrically with respect to the two-dimensional sensor 27 enables the imaging unit 20 to capture an image capture face under an illumination condition same as an illumination condition under which the reference chart 300 is captured. In addition, the type of the light source 58 is not limited to the LED although the LED is used as the light source 58 in the present embodiment. For example, organic electro luminescence (EL) can be used as the light source 58. Using the organic EL as the light source 58 can provide illumination light having spectral distribution similar to the spectral distribution of sunlight. This can improve the colorimetric accuracy.

As illustrated in FIG. 8, the sensor unit 26 further includes a light absorber 55*c* immediately below the light source 58 and the two-dimensional sensor 27. The light absorber 55*c* absorbs the light from the light source 58 or reflects the light in a direction in which the two-dimensional sensor 27 is not disposed. The light absorber 55*c* has an acute shape to reflect the incident light from the light source 58 to the inner face of the light absorber 55*c* and not to reflect the light in a direction in which the incident light enters.

Inside the housing 51, a light path length changer 59 is disposed on a light path between the sensor unit 26 and the test pattern TP outside the housing 51 to be captured by the sensor unit 26 through the opening 53. The light path length changer 59 is an optical element having a refractive index n that has sufficient transmittance enabling the light of the light source 58 to pass through. The light path length changer 59 is to bring the imaging face where the test pattern TP outside the housing 51 is optically imaged close to the imaging face where the reference chart 300 inside the housing 51 is optically imaged. In other words, in the imaging unit 20, placing the light path length changer 59 on a light path between the sensor unit 26 and the captured object outside the housing 51 changes the light path length. With this structure of the imaging unit 20, both of the imaging face where the test pattern TP outside the housing 51 is optically imaged and the imaging face where the reference chart 300 inside the housing 51 is optically imaged are adjusted for the light receiving surface of the two-dimensional sensor 27 of the sensor unit 26. Thus, the sensor unit 26 can capture an image in which the test pattern TP outside the housing 51 and the reference chart 300 inside the housing 51 are in focus.

For example, a pair of ribs 60 and 61 supports both edges of the face of the light path length changer 59 facing the bottom board 51*a* as illustrated in FIG. 6. In addition, placing a pressing member 62 between the face of the light path length changer 59 facing the top board 51*b* and the circuit board 54 prevents the light path length changer 59 from moving in the housing 51. The light path length changer 59 is disposed at a position where the light path length changer 59 seals the opening 53 on the bottom board 51*a* of the housing 51. Thus, the light path length changer 59 also has a function of preventing impurities such as an ink mist or dust entering the housing 51 from the outside of the housing 51 through the opening 53 from adhering, for example, to the sensor unit 26, the light sources 58, and the reference chart 300.

Note that the mechanical configuration of the imaging unit 20 described above is merely an example, and the mechanical configuration is not limited to the example. The imaging unit 20 can has any structure as long as the sensor unit 26 in the housing 51 captures an image of the test pattern TP outside the housing 51 through the opening 53 while the light sources 58 in the housing 51 are on (emit light). The imaging unit 20 can be variously modified from the above-described structure.

For example, the imaging unit 20 described above includes the reference chart 300 on the inner face of the bottom board 51*a* of the housing 51. Alternatively, the imaging unit 20 haves a structure in which another opening different from the opening 53 is disposed at the position on the bottom board 51*a* of the housing 51 where the reference chart 300 is disposed so that the reference chart 300 is attached to the position where the opening is disposed from the outside the housing 51. In this example, the sensor unit 26 captures an image of the test pattern TP on the recording medium P through the opening 53 and simultaneously captures an image of the reference chart 300 attached to the bottom board 51*a* of the housing 51 from the outside through the opening different from the opening 53. This example has an advantage to make it easy to exchange the reference chart 300 at the occurrence of a problem such as a smudging of the reference chart 300.

Figure 9:
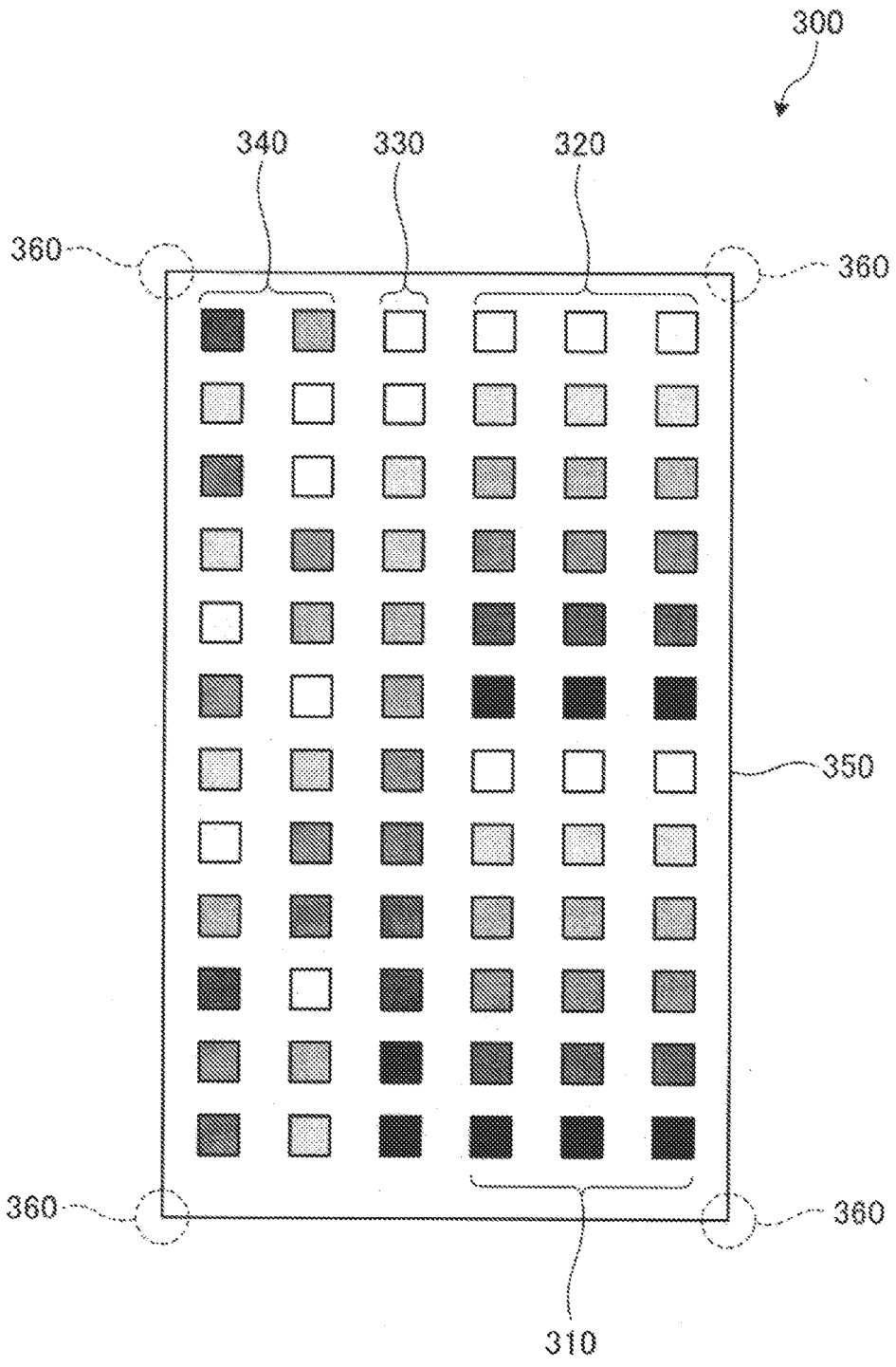
FIG. 9 is a diagram of an example of a reference chart according to Embodiment 1.

Next, an example of the reference chart 300 disposed in the housing 51 of the imaging unit 20 will be described referring to FIG. 9. FIG. 9 illustrates an example of the reference chart.

The reference chart 300 illustrated in FIG. 9 includes a plurality of colorimetric patch lines 310 to 340 in which colorimetric patches for colorimetry are lined, a distance measurement line 350, and chart position determination marks 360.

The colorimetric patch line 310 includes colorimetric patches for primary colors, yellow (Y), magenta (M), cyan (C), and black (K), arranged in gradation order. The colorimetric patch line 320 includes colorimetric patches for secondary colors, red (R), green (G), and blue (B), arranged in gradation order. The colorimetric patch line 330 (an achromatic gradation pattern) includes colorimetric patches for gray scale arranged in gradation order. The colorimetric patch line 340 includes colorimetric patches for tertiary colors arranged in gradation order.

The distance measurement line 350 is a rectangular frame surrounding the plurality of colorimetric patch lines 310 to 340. The chart position determination marks 360 are disposed on the four corners of the distance measurement line 350 and function as markers to determine the position of each of the colorimetric patches. In the image of the reference chart 300 captured with the sensor unit 26, the distance measurement line 350 and the chart position determination marks 360 on the four corners thereof are identified to determine the position of the reference chart 300 and the position of each of the colorimetric patches.

Each of the colorimetric patches included in the colorimetric patch lines 310 to 340 for colorimetry is used as a reference to determine the color tone reflecting the condition under which the sensor unit 26 captures the image. Note that the structures of the colorimetric patch lines 310 to 340 for colorimetry in the reference chart 300 are not limited to the example illustrated in FIG. 9, and an arbitrary colorimetric patch line can be used. For example, a colorimetric patch that can determine colors in a color range as wide as possible can be used. Alternatively, the colorimetric patch line 310 for the primary colors YMCK or the colorimetric patch line 330 for gray scale can include a patch having a colorimetric value of the coloring material used in the image forming apparatus 100. Alternatively, the colorimetric patch line 320 for the secondary colors RGB can include a patch having a colorimetric value to be reproduced with the coloring material used in the image forming apparatus 100. Furthermore, a reference color patch having a colorimetric value specified in Japan Color can be used.

Note that, although the reference chart 300 according to the present embodiment uses the colorimetric patch lines 310 to 340 including patches (color patches) of a typical shape, the reference chart 300 does not necessarily include such colorimetric patch lines 310 to 340. The reference chart 300 can have any configuration in which a plurality of colors for colorimetry is arranged so that the positions thereof can be identified.

As described above, the reference chart 300 is disposed on the inner face of the bottom board 51*a* of the housing 51 and on a side of the opening 53. Accordingly, the sensor unit 26 can simultaneously capture an image of the reference chart 300 and an image of the test pattern TP outside the housing 51. Note that the simultaneous image capture in this example means that acquiring image data of a frame including the test pattern TP outside the housing 51 and the reference chart 300. In other words, even if the data of each pixel is obtained at a different time, as long as image data of a frame including the test pattern TP outside the housing 51 and the reference chart 300 is acquired, the test pattern TP outside the housing 51 and the reference chart 300 are captured at the same time as one image.

[Example 2 of Imaging Unit]

Figure 10:
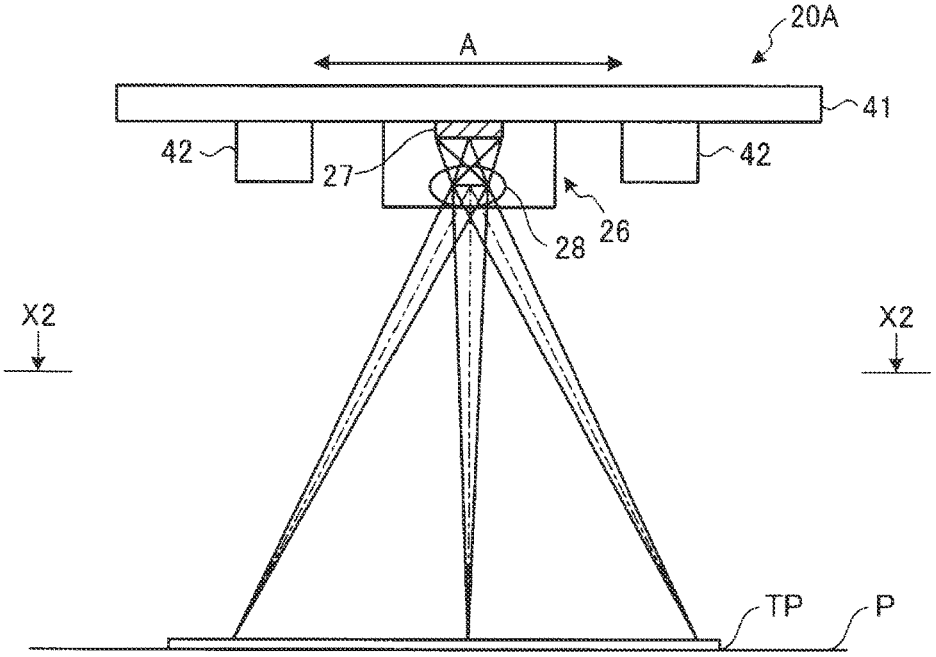
FIG. 10 is a vertical cross-sectional view of another structure of the imaging unit according to Embodiment 1.
Figure 11:
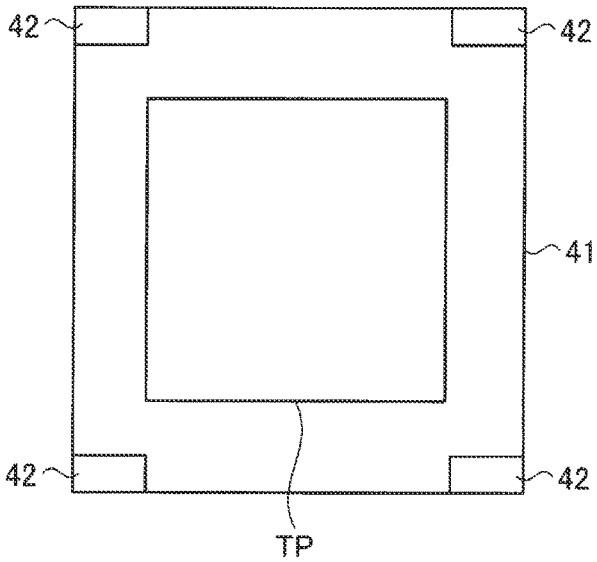
FIG. 11 is a plan view of the imaging unit of FIG. 10, as viewed in the direction indicated by arrow X2.

A specific example of an imaging unit without a reference chart will be described, referring to FIGS. 10 and 11. FIG. 10 is a vertical cross-sectional view of an imaging unit 20A. FIG. 11 is a plan view of the imaging unit 20A, as viewed in the direction indicated by arrow X2.

As illustrated in FIG. 10, the imaging unit 20 includes a substrate 41 secured to a carriage 5, light sources 42, and a sensor unit 26. The light sources 42 and the sensor unit 26 are mounted on the substrate 41.

For example, an LED is used as the light source 42. The test pattern TP on the recording medium P that is a captured object is irradiated with illumination light, and the light reflected (diffusely or specularly) therefrom enters the sensor unit 26. As illustrated in FIG. 11, four light sources 42 are disposed to surround the test pattern TP on the recording medium P so as to evenly irradiate the test pattern TP with the illumination light.

The sensor unit 26 includes a two-dimensional sensor 27 such as a CCD sensor or a CMOS sensor and an imaging lens 28. The sensor unit 26 causes the reflected light of the illumination light, emitted from the light source 42 to the test pattern TP, to enter the two-dimensional sensor 27 through the imaging lens 28. The two-dimensional sensor 27 converts the entering light into an analog signal by photoelectric conversion, and outputs the signal as the captured image of the test pattern TP.

[Number of Nozzles Driven in Recording Head]

Next, a description is given of the number of nozzles in the recording head 6. As illustrated in FIG. 3, each of the recording heads 6A, 6B, and 6C according to the present embodiment includes one line of nozzles to discharge ink droplets for each of yellow (Y), cyan (C), magenta (M), and black (K). That is, each recording head 6 has four nozzle lines.

Figure 12:
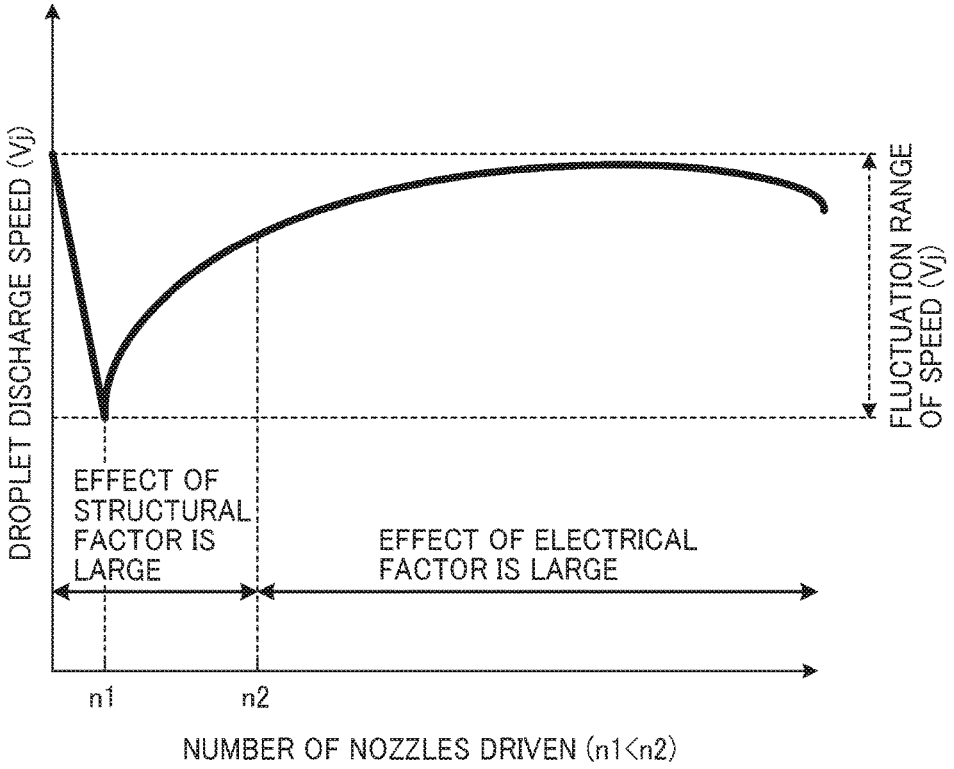
FIG. 12 is a graph for explaining droplet discharge characteristics of a recording head.

Here, a description is given below of the relation between the number of nozzles driven and discharge speed of droplet (ink), as a droplet discharge characteristic. FIG. 12 is a graph for explaining the droplet discharge characteristic of the recording head. The term "number of nozzles driven" represents the number of nozzles in the same recording head 6 that discharge ink droplets concurrently. Corresponding to the number of nozzles driven, the discharge speed of droplet (Vj) changes significantly. The causes of changes include a structural factor and an electrical factor.

For example, in a case in which the recording head 6 employs a piezo (piezoelectric element) actuator, there is the following structural factor. In the piezo actuator type, a drive waveform is applied to the piezo to cause a displacement of the piezoelectric element, thereby pressurizing the ink inside a pressurizing chamber to discharge an ink droplet from the nozzle. At that time, depending on the number of nozzles driven, the pressure applied to the ink inside the pressurizing chamber changes, and the discharge speed of droplet (Vj) changes. Even in a thermal inkjet recording apparatus, since bubbles are generated inside the pressurizing chamber to pressurize the ink therein, a similar phenomenon can occur.

Regarding an electrical factor, the recording head 6 behaves such that capacitance and inductance change depending on the number of nozzles driven and wiring length. Such changes cause a waveform output from a drive waveform generation circuit to fluctuate, affecting the discharge speed of droplet (Vj).

Depending on the number of nozzles driven, the influence of either of the two factors is dominant. Here, numbers n1 and n2 (in FIG. 12) represent the numbers of nozzles driven and n2 is greater than n1. When the number of nozzles driven is around the number n1, the influence of the structural factor is greater. By contrast, when the number of nozzles driven exceeds the number n2, the influence of the electrical factor is greater. Variations of fluctuation in the discharge speed of droplet (Vj) caused by the electrical factor can be easily suppressed by, for example, adjustment of a circuit constant. By contrast, suppressing variations caused by the structural factor is difficult.

As illustrated in FIG. 12, as the number of nozzles driven increases, the discharge speed of droplet (Vj) becomes stable. Accordingly, preferably, the number of nozzles for each color of the recording head 6 is equal to or greater than the number n2 at which the influence of the electrical factor is greater than that of the structural factor.

[Hardware Configuration of Image Forming Apparatus]

Figure 13:
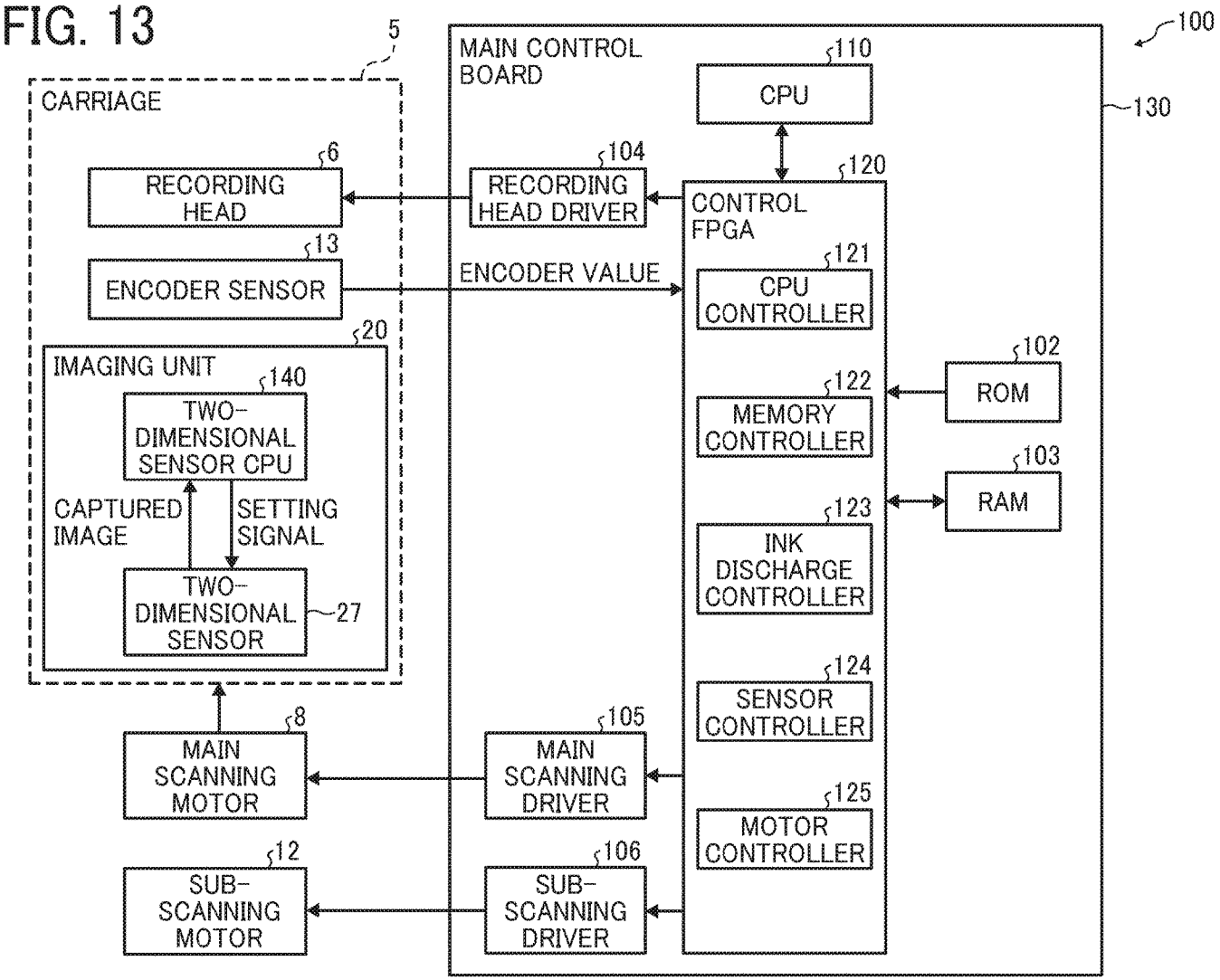
FIG. 13 is a block diagram of a hardware configuration of the image forming apparatus according to Embodiment 1.

A hardware configuration of the image forming apparatus 100 according to the present embodiment will be described referring to FIG. 13. FIG. 13 is a block diagram of the hardware configuration of the image forming apparatus according to Embodiment 1.

As illustrated in FIG. 13, the image forming apparatus 100 according to the present embodiment includes a central processing unit (CPU) 110, a read-only memory (ROM) 102, a random access memory (RAM) 103, a recording head driver 104, a main scanning driver 105, a sub-scanning driver 106, a control Field-Programmable Gate Array (FPGA) 120, a recording head 6, an encoder sensor 13, the imaging unit 20, a main scanning motor 8, and a sub-scanning motor 12. The CPU 110 is an example of at least one processor.

The CPU 110, the ROM 102, the RAM 103, the recording head driver 104, the main scanning driver 105, the sub-scanning driver 106, and the control FPGA 120 are mounted on a main control board 130. Meanwhile, the recording head 6, the encoder sensor 13, and the imaging unit 20 are mounted on the carriage 5 as described above.

The CPU 110 controls the entire image forming apparatus 100. For example, the CPU 110 uses the RAM 103 as a work area to execute various control programs stored on the ROM 102 in order to output a control command to control each operation in the image forming apparatus 100. In particular, the image forming apparatus 100 according to the present embodiment uses the CPU 110 to implement, for example, a function to form the test pattern TP and a reference frame F (illustrated in FIG. 15A) to locate the test pattern TP, a function to measure distance, and a function to adjust a parameter relating to the position of image formation based on the distance. Those functions will be described in detail later.

The recording head driver 104, the main scanning driver 105, and the sub-scanning driver 106 drive the recording head 6, the main scanning motor 8, and the sub-scanning motor 12, respectively.

The control FPGA 120 cooperates with the CPU 110 to control various types of operation in the image forming apparatus 100. The control FPGA 120 includes, for example, a CPU controller 121, a memory controller 122, an ink discharge controller 123, a sensor controller 124, and a motor controller 125 as functional components.

The CPU controller 121 communicates with the CPU 110 to transmit various types of information that the control FPGA 120 obtains to the CPU 110 and input a control command output from the CPU 110.

The memory controller 122 performs memory control to enable the CPU 110 to access the ROM 102 or the RAM 103.

The ink discharge controller 123 controls the operation of the recording head driver 104 in response to the control command from the CPU 110 in order to control the discharge timing at which ink is discharged from the recording head 6 driven by the recording head driver 104.

The sensor controller 124 processes a sensor signal such as encoder values output from the encoder sensor 13. For example, the sensor controller 124 performs a process for calculating, for example, the position, travel speed, and travel direction of the carriage 5 based on the encoder value output from the encoder sensor 13.

The motor controller 125 controls the operation of the main scanning driver 105 in response to the control command from the CPU 110 to control the main scanning motor 8 driven by the main scanning driver 105 in order to control the movement of the carriage 5 in the main scanning direction A. The motor controller 125 similarly controls the operation of the sub-scanning driver 106 in response to the control command from the CPU 110 to control the sub-scanning motor 12 driven by the sub-scanning driver 106 in order to control the movement (conveyance) of the recording medium P on the platen 16 in the sub-scanning direction B.

Note that each component described above is an exemplary control function implemented by the control FPGA 120, and other control functions than the functions described above can also be implemented by the control FPGA 120. Alternatively, all or some of the control functions described above can be implemented by the program executed by the CPU 110 or another general-purpose CPU. Alternatively, some of the control functions described above can be implemented by dedicated hardware such as another FPGA different from the control FPGA 120 or an application specific integrated circuit (ASIC).

The recording head 6 discharges ink onto the recording medium P on the platen 16 to form an image, driven by the recording head driver 104. The CPU 110 and the control FPGA 120 control the recording head driver 104.

The encoder sensor 13 detects the mark of the encoder sheet 14 to obtain an encoder value, and outputs the obtained encoder value to the control FPGA 120. The sensor controller 124 of the control FPGA 120 uses the output encoder value to calculate the position, travel speed, and travel direction of the carriage 5. The position, travel speed, and travel direction of the carriage 5, which are calculated by the sensor controller 124 according to the encoder value, are transmitted to the CPU 110. The CPU 110 generates a control command to control the main scanning motor 8 according to the calculated position, travel speed, and travel direction of the carriage 5, and outputs the control command to the motor controller 125.

The imaging unit 20 captures an image of the test pattern TP and the reference frame F (illustrated in FIG. 15A) on the recording medium P and performs various processing of the captured image, controlled by the CPU 110. The imaging unit 20 includes a two-dimensional sensor CPU 140 and the two-dimensional sensor 27. The CPU 140 is an example of at least one processor.

The two-dimensional sensor 27 is, for example, a CCD sensor or a CMOS sensor as described above. The two-dimensional sensor 27 captures an image of the test pattern TP and the reference frame F under predetermined operation conditions according to various setting signals transmitted from the two-dimensional sensor CPU 140. Then, the two-dimensional sensor 27 transmits the captured image to the two-dimensional sensor CPU 140.

The two-dimensional sensor CPU 140 controls the two-dimensional sensor 27 and processes the image captured by the two-dimensional sensor 27. In specific, the two-dimensional sensor CPU 140 transmits various setting signals to the imaging unit 20 in order to set various operation conditions under which the two-dimensional sensor 27 operates. In addition, the two-dimensional sensor CPU 140 implements detection of marks of the test pattern TP, with reference to the reference frame F, in the captured image, and calculation of the ratio between the distance in the captured image and the actual distance. Those functions will be described in detail later.

The imaging unit 20 further includes a RAM and a ROM so that, for example, the two-dimensional sensor CPU 140 uses the RAM as a work area to execute various control programs stored on the ROM in order to output a control command to control each operation of the imaging unit 20. In addition, the two-dimensional sensor CPU 140 has functions of converting the analog signal obtained in the photoelectric conversion by the two-dimensional sensor 27 into the digital image data in AD conversion and processing the digital image data in various image processing processes such as shading correction, white-balance correction, γ correction, and image data format conversion. Some of or the entire image processing processes for the captured image can be performed outside the imaging unit 20.

In the image forming apparatus 100 according to the present embodiment, the recording head driver 104, the main scanning driver 105, the sub-scanning driver 106, the recording head 6, the main scanning motor 8, and the sub-scanning motor 12 together function as an image forming device to form an image on the recording medium P. The recording head driver 104, the main scanning driver 105, and the sub-scanning driver 106 are controlled by the CPU 110 and the control FPGA 120. The recording head 6, the main scanning motor 8, and the sub-scanning motor 12 are driven by those drivers.

In FIG. 13, the two-dimensional sensor CPU 140 and the imaging unit 20 are mounted on the carriage 5. However, the two-dimensional sensor CPU 140 and the imaging unit 20 can be disposed at any positions where the two-dimensional sensor CPU 140 and the imaging unit 20 can appropriately capture an image of the test pattern TP on the recording medium P. Thus, the two-dimensional sensor CPU 140 and the imaging unit 20 are not necessarily mounted on the carriage 5.

[Functional Configuration of Image Forming Apparatus]

Figure 14:
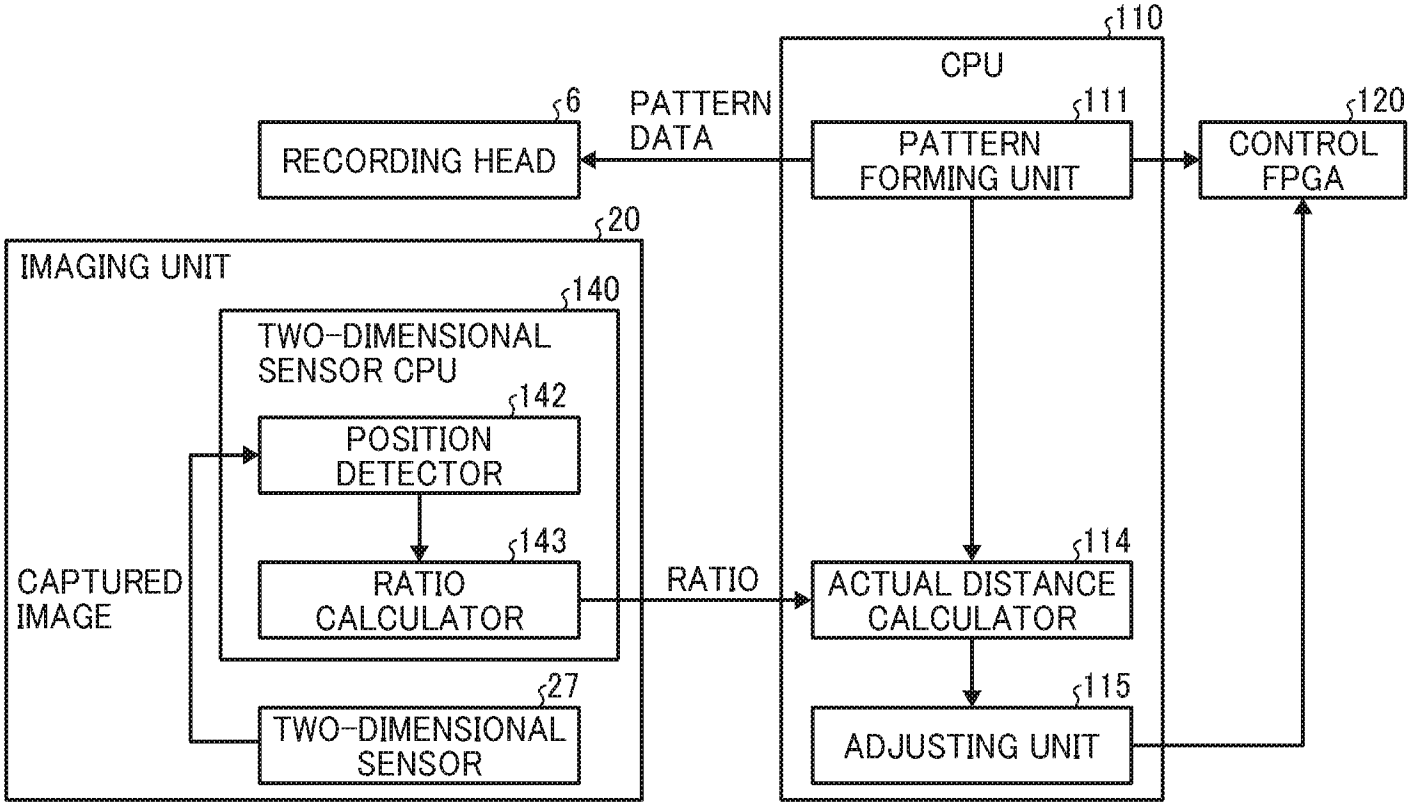
FIG. 14 is a block diagram of a functional configuration of the image forming apparatus according to Embodiment 1.

Characteristic functions implemented by the CPU 110 and two-dimensional sensor CPU 140 of the image forming apparatus 100 will be described, referring to FIG. 14. FIG. 14 is a block diagram of a functional configuration of the image forming apparatus 100 according to Embodiment 1.

For example, the CPU 110 uses the RAM 103 as a work area to execute a control program stored on the ROM 102 in order to implement, for example, the functions of the pattern forming unit 111, the actual distance calculator 114, and the adjusting unit 115. For example, the two-dimensional sensor CPU 140 of the imaging unit 20 similarly uses the RAM as a work area to execute a control program stored on the ROM in order to implement, for example, the functions of the position detector 142 and the ratio calculator 143.

The pattern forming unit 111 of the CPU 110 reads the pattern data preliminarily stored, for example, on the ROM 102 and causes the image forming device described above to form, according to the pattern data, the test pattern TP and the reference frame F on the recording medium P. The imaging unit 20 captures an image of the test pattern TP and the reference frame F on the recording medium P formed by the pattern forming unit 111.

Figure 15A:
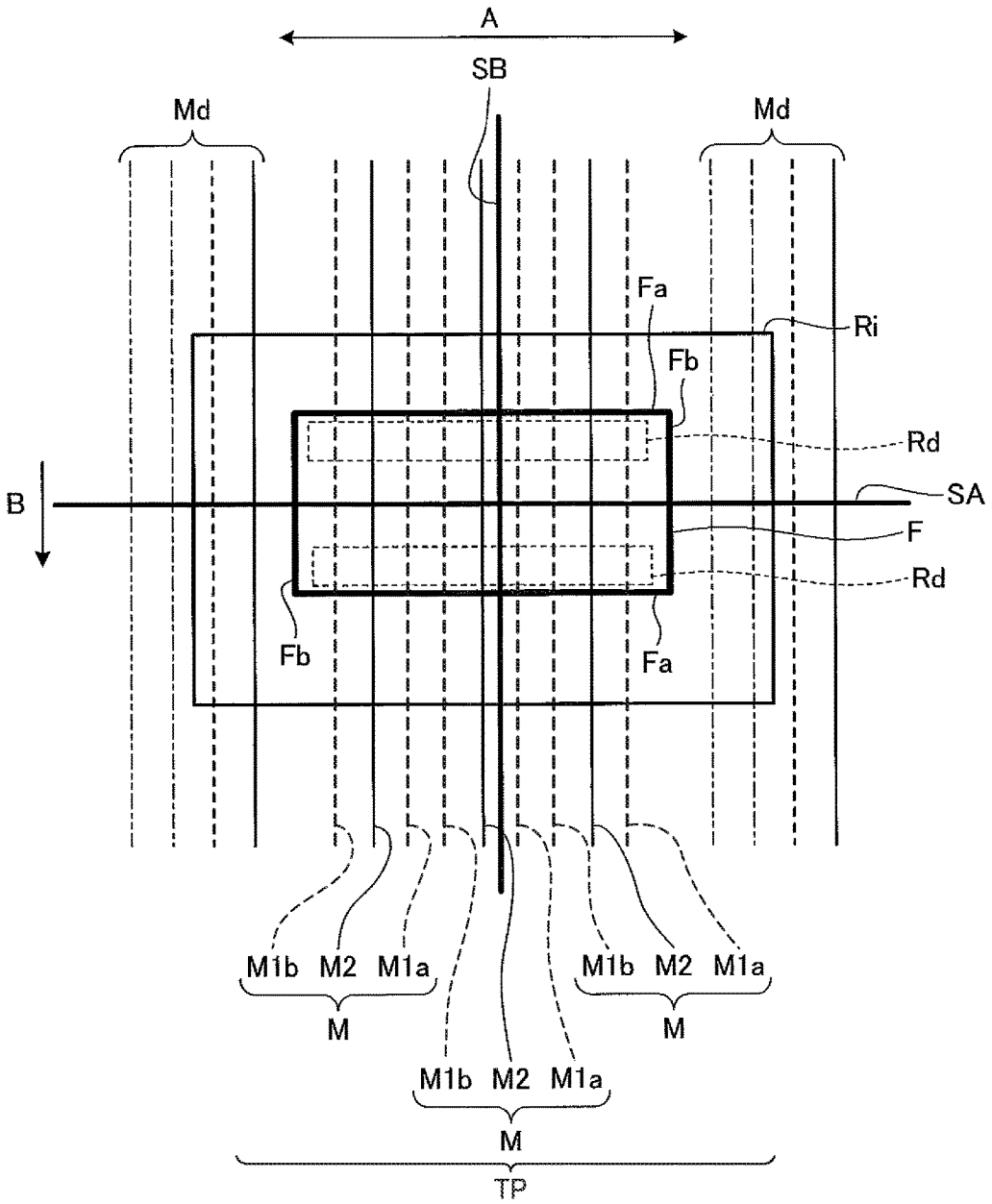
FIG. 15A illustrates a test pattern on a recording medium and a reference frame, according to an embodiment.

Descriptions are given below of the test pattern TP and the reference frame F. FIG. 15A illustrates an example of the test pattern TP on the recording medium P and the reference frame F. As illustrated in FIG. 15A, the test pattern TP includes at least one mark set M each including a pair of first marks M1*a* and M1*b* and a second mark M2. In the test pattern TP illustrated in FIG. 15A, the second mark M2 is disposed at a midpoint position between the first marks M1*a* and M1*b*. The pair of first marks M1*a* and M1*b* and the second mark M2 are lines and extend in the sub-scanning direction B, in which the recording medium P is conveyed. In FIG. 15A, three mark sets M are disposed side by side in the main scanning direction A, in which the carriage 5 moves. For example, the three mark sets M are the same in shape but different in color. Forming mark sets of different colors at a time streamlines detection of deviation in the different colors.

When the condition under which the pair of first marks M1*a* and M1*b* is formed is referred to as a first condition, the second mark M2 is formed under a second condition different from the first condition. The difference in condition for forming marks includes the difference in the travel direction of the carriage 5 carrying the recording head 6, the difference of the recording head 6 to discharge ink, and the like.

The description below is based on an assumption that the condition under which the second mark M2 is formed is different in the direction of travel of the carriage 5 (forward or backward) from the condition for forming the pair of first marks M1*a* and M1*b*. Specifically, for example, in the case of the mark set M illustrated in FIG. 15A, the pair of first marks M1*a* and M1*b* is formed during forward travel of the carriage 5, by discharging ink onto the recording medium P from designated nozzles, of the plurality of nozzles of the recording head 6 mounted on the carriage 5. By contrast, the second mark M2 is formed during backward travel of the carriage 5, by discharging ink onto the recording medium P from the identical nozzles that has discharged ink in formation of the pair of first marks M1*a* and M1*b*.

As described above, the ink landing position may be different between the forward travel and the backward travel of the carriage 5. Accordingly, in the test pattern TP, it is possible that the relative positions of the first marks M1*a* and M1*b* hardly change while the position of the second mark M2 relative to the pair of first marks M1*a* and M1*b* changes. The change in position is a deviation in landing position of ink caused by the difference between the forward travel of the carriage 5 and backward travel of the carriage 5.

In the description above, the pair of first marks M1*a* and M1*b* is formed while the carriage 5 moves in the forward direction and the second mark M2 is formed while the carriage 5 moves in the backward direction. Alternatively, the order of formation of marks can be reversed. That is, the second mark M2 can be formed while the carriage 5 moves in the forward direction and the pair of first marks M1*a* and M1*b* can be formed while the carriage 5 moves in the backward direction.

Additionally, in the description above, the pattern forming unit 111 causes the recording head 6 to discharge ink from same nozzles of the plurality of nozzles, to form the pair of first marks M1*a* and M1*b* and the second mark M2. Alternatively, the nozzles discharge ink to form the pair of first marks M1*a* and M1*b* can be different from the nozzles to discharge ink to form the second mark M2. In this case, if there is misalignment between these nozzles in the main scanning direction A, the test pattern is affected. However, the mount of misalignment between the nozzles of one recording head 6 is very small and ignorable compared with the deviation in landing position of ink caused by the difference in the direction of travel of the carriage 5.

Note that this explanation is applicable to a case where the second mark M2 is formed with the recording head 6 (e.g., the recording head 6B) different from the recording head 6 (e.g., the recording head 6A) to form the first marks M1*a* and M1*b*. Specifically, if the relative positions among the plurality of recording heads 6 differ from the designed relative positions due to an error in attaching the plurality of recording heads 6 to the carriage 5, landing position of ink deviates. In this case, when the second mark M2 and the pair of the first marks M1*a* and M1*b* are formed with the different recording heads 6, the position of the second mark M2 relative to the pair of first marks M1*a* and M1*b* differs from the designed relation while the relative positions between the first marks M1*a* and M1*b* hardly change.

As long as the test pattern TP includes the pair of first marks M1*a* and M1*b* formed under the first condition and the second mark M2 formed under the second condition different from the first condition, the relative positions of the pair of first marks M1*a* and M1*b* and the second mark M2 can be set freely. The position and timing to form each of the pair of first marks M1*a* and M1*b* and the second mark M2 included in the test pattern TP are indicated in the pattern data described above. According to the timing mentioned here, the mark is formed in either in the forward travel of the carriage 5 or the backward travel of the carriage 5.

In FIG. 15A, the reference frame F is formed together with either the pairs of first marks M1*a* and M1*b* or the second marks M2 and used as a reference in locating the test pattern TP. The reference frame F is formed in the forward travel of the carriage 5 when formed together with the pair of first marks M1*a* and M1*b*. Alternatively, the reference frame F is formed in the backward travel of the carriage 5 when formed together with the second mark M2. The reference frame F is formed as a rectangle with the two pairs of reference lines, one of which (the pair of reference lines Fb) extends in the sub-scanning direction B in which the recording medium P is conveyed. The other pair (the reference lines Fa) extends in the main scanning direction A. In one embodiment, the reference frame F is formed with a line thicker than the linear marks of the test pattern TP to be distinguished from the linear marks of the test pattern TP. Then, the position detector 142 detects the test pattern TP inside a detection area Rd positioned within the reference frame F. Note that the reference frame F is formed together with the pair of first marks M1*a* and M1*b* in the present embodiment. The reference lines Fa and Fb are examples of a reference mark.

The imaging unit 20 captures an image of the image capture range Ri illustrated in FIG. 15A to capture the test pattern TP and the reference frame F. That is, the reference frame F formed on the recording medium P surrounds a predetermined area smaller than the image capture range Ri. Further, as illustrated in FIG. 15A, in the sub-scanning direction B, the pair of first marks M1*a* and M1*b* and the second mark M2 are longer than the reference frame F and longer than the image capture range Ri captured by the imaging unit 20. Such setting is made considering the characteristics of discharge of ink from the nozzles of the recording heads 6 described above with reference to FIG. 12.

The position of the reference frame F is described. When an image of the reference frame F is captured by the imaging unit 20A (see FIGS. 10 and 11) that does not include the reference chart 300 illustrated in FIG. 9, the image capture range Ri is preferably set so that the reference frame F is positioned near the center of the image capture range Ri. On the other hand, when an image of the reference frame F is captured with the imaging unit 20 having the reference chart 300 (see FIGS. 4 to 8), the image capture range Ri is preferably set to satisfy the following conditions: Conditions 1) the reference frame F is positioned to be captured from the opening 53 without the reference chart 300, and Condition 2) the reference frame F is near the optical axis of the light emitted from the light source 58.

Referring back to FIG. 14, the position detector 142 of the two-dimensional sensor CPU 140 processes the image captured with the imaging unit 20 in a predetermined process such as a binarization process to detect the reference frame F in the captured image and further detect each of the pair of first marks M1*a* and M1*b* and the second mark M2 within the reference frame F.

In the example illustrated in FIG. 15A, the test pattern TP formed on the recording medium P includes the plurality of mark sets M and further includes a plurality of mark sets Md that is not used in calculation of the deviation. The imaging unit 20 captures an image of an image capture range Ri including the test pattern TP and the reference frame F. Initially, the position detector 142 detects the reference frame F inside the image capture range Ri.

Figure 16:
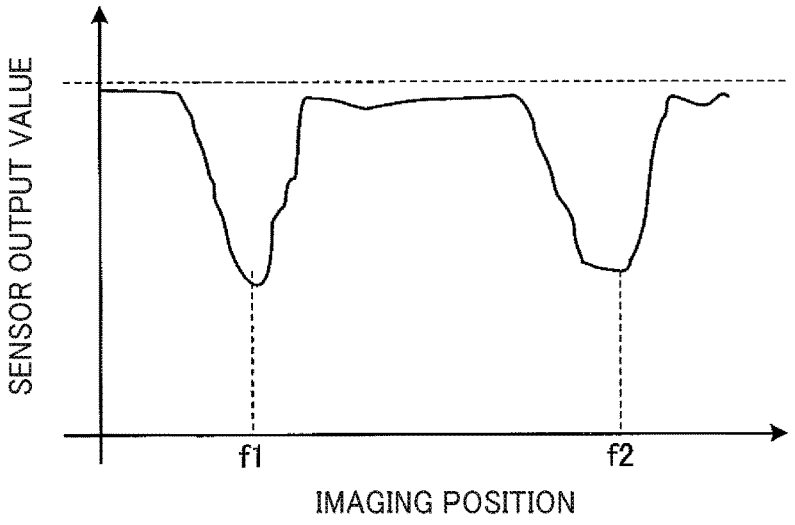
FIG. 16 is a graph illustrating a relation between the position of imaging by the imaging unit and output value of a two-dimensional sensor according to an embodiment.

FIG. 16 is a graph illustrating a relation between the position of image capturing by the imaging unit 20 and output value of the two-dimensional sensor 27. In FIG. 16, the reference frame F illustrated in FIG. 15A is identified by a sensor output value at a measurement position SA or a sensor output value at a measurement position SB. In other words, at the measurement position SA, a pair of reference lines Fb is represented by sensor output values f1 and f2 in FIG. 16. At the measurement position SB, a pair of reference lines Fa is represented by sensor output values f1 and f2 in FIG. 16. The reference lines Fa extending in main scanning direction A and the reference lines Fb extending in the sub-scanning direction B are thus located to identify the reference frame F inside the image capture range Ri.

Since the reference frame F is formed together with one of the pairs of first marks M1*a* and M1*b* and the second marks M2, the position detector 142 can easily locate the first and second marks M1*a*, M1*b*, and M2 of the test pattern TP. In the present embodiment, the reference frame F is formed together with the pair of first marks M1*a* and M1*b* as described above. Accordingly, the relative positions between the first marks M1*a* and M1*b* and the reference frame F are not likely to change. Therefore, the position detector 142 locates the first marks M1*a* and M1*b* disposed at a predetermined position from the reference lines Fb of the reference frame F and then locates the second mark M2 disposed between the pair of first marks M1*a* and M1*b*.

Figure 15B:
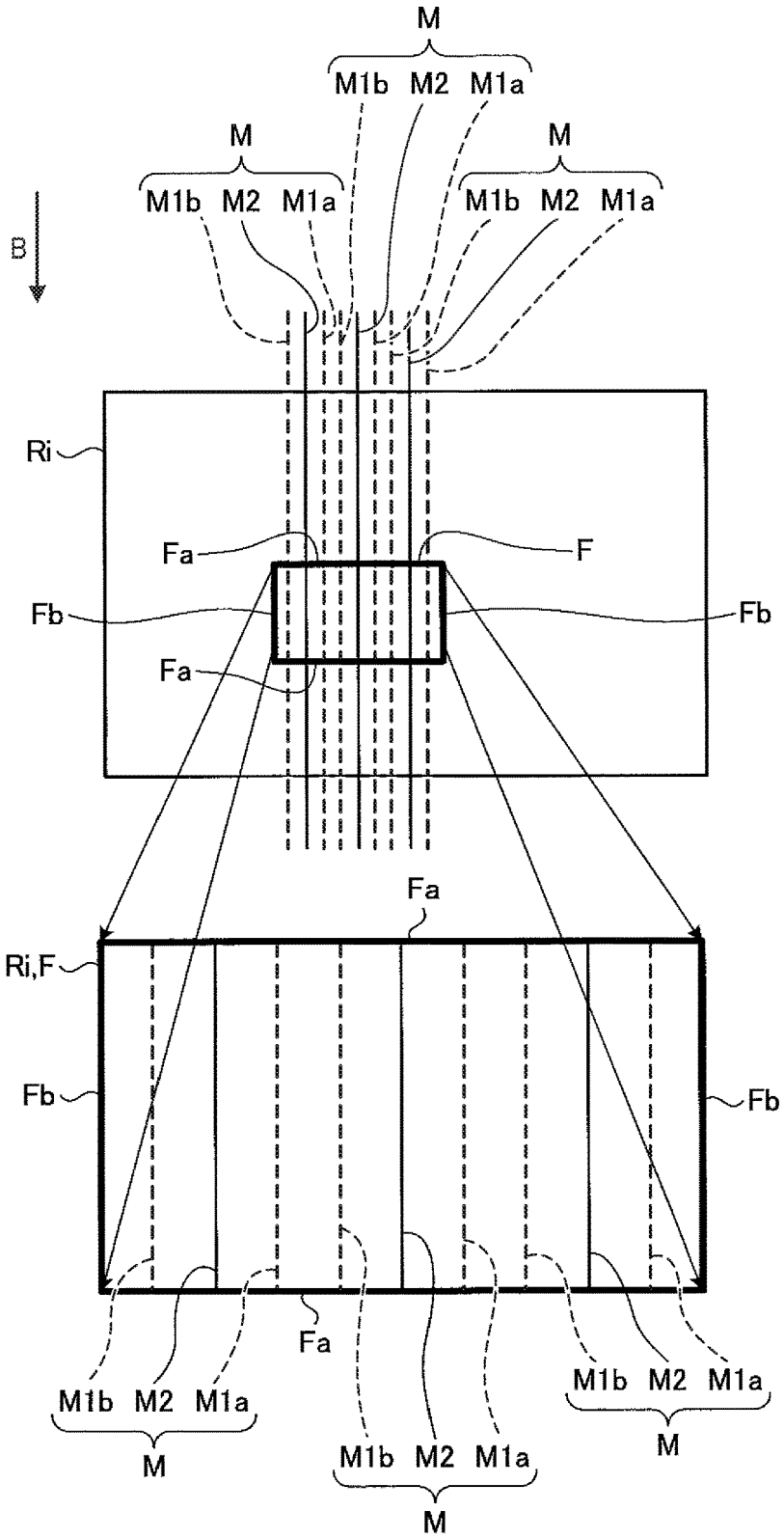
FIG. 15B illustrates a captured image in which magnification is adjusted, according to an embodiment.

Adjusting the magnification of the captured image is advantageous in locating the pair of first marks M1*a* and M1*b* with reference to the reference frame F. FIG. 15B illustrates an example of the captured image when the magnification is adjusted. As illustrated in FIG. 15B, when the magnification of the captured image is adjusted in accordance with the reference frame F, fluctuations in position are reduced in the portion extending from the reference lines Fb to the mark set M in the captured image. Accordingly, locating the pair of first marks M1*a* and M1*b* is facilitated.

The position detected here is a position on dimensional coordinates of an image represented per pixel. In many cases, the pair of first marks M1*a* and M1*b* and the second mark M2 in the captured image are detected as lines formed with a plurality of pixels. For example, a center position of a line located at a predetermined position in the sub-scanning direction B can be detected as a representative position of the first mark M1*a* or M1*b*, or the second mark M2. The positions of the pair of first marks M1*a* and M1*b* and the second mark M2 in the captured image, detected by the position detector 142, are transmitted to the ratio calculator 143.

Figure 17:
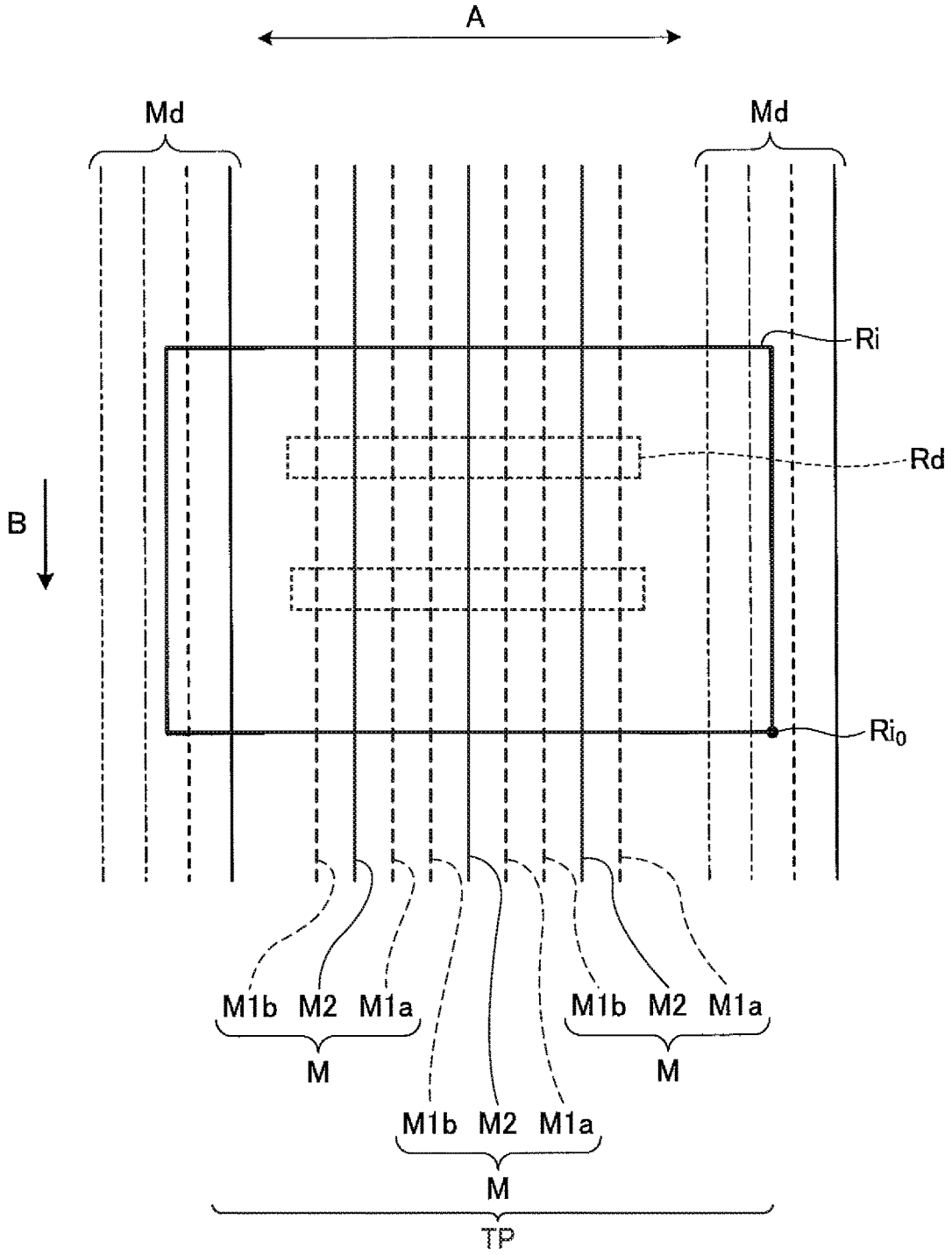
FIG. 17 illustrates an example of a test pattern without the reference frame, formed on a recording medium, as a comparative example.

Descriptions are given below of detection of the test pattern TP in a case where the reference frame F is not formed. FIG. 17 illustrates a comparative example of the mark sets M that are not accompanied with the reference frame F, on the recording medium P. As illustrated in FIG. 17, when the reference frame F is not formed, the position detector 142 measures the image capture range Ri entirely from a predetermined start position $Ri_0$ of the image capture range Ri in both the main scanning direction A and the sub-scanning direction B, thereby detecting the pair of first marks M1*a* and M1*b* and the second mark M2. Therefore, at the occurrence of the deviation of marks of the test pattern TP, for example, the position detector 142 may erroneously recognize the mark set Md as the mark set M and fail to identify the first marks M1*a* and M1*b* and the second mark M2. Consequently, the ratio calculator 143 fails to calculate the deviation amount. By contrast, in the present embodiment, the reference frame F is formed to ensure identifying and detecting the test pattern TP.

Note that, although the test pattern TP is detected with reference to the rectangular reference frame F formed with two pairs of the reference lines (Fa and Fb) in the description above, alternatively, the test pattern TP can be detected with reference to the pair of reference lines Fb instead of the reference frame F. In such a case, as the reference lines Fb are identified from the sensor output values in the main scanning direction A, the test pattern TP interposed between the two reference lines Fb can be detected. However, in the case where there are two detection areas Rd as illustrated in FIG. 15A, the mark sets M are lined in the sub-scanning direction B. In this case, the reference lines Fa are required to identify the position in the sub-scanning direction B.

The ratio calculator 143 of the two-dimensional sensor CPU 140 calculates the ratio between the distance between the pair of the first marks M1*a* and M1*b* in the captured image and the amount of deviation of the second mark M2 in the captured image based on the positions of the pair of first marks M1*a* and M1*b* and the second mark M2 in the captured image.

Figure 18:
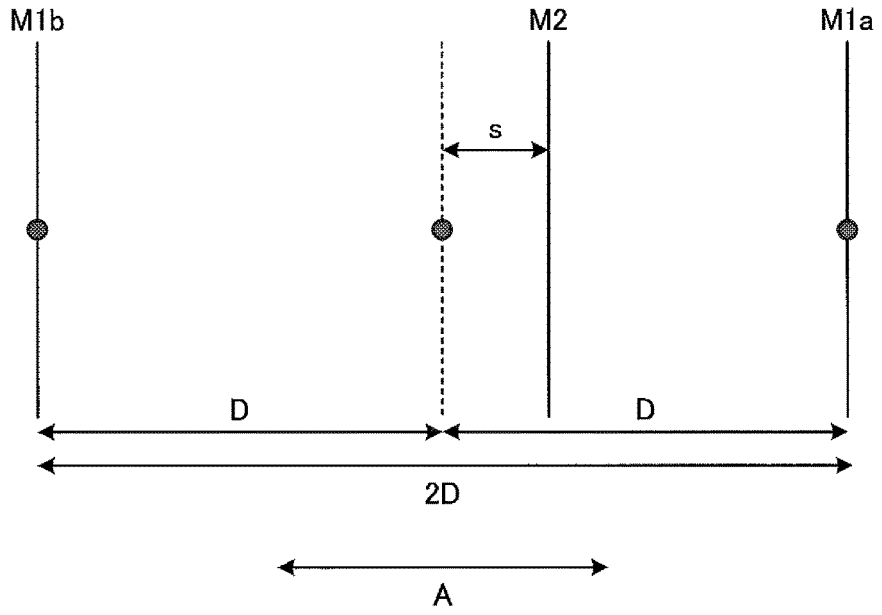
FIG. 18 is a diagram of a method for calculating a ratio between a distance between the pair of first marks and the amount of deviation of the second mark in a captured image, according to Embodiment 1.

A method for calculating the ratio will be described in detail, referring to FIG. 18. FIG. 18 is a diagram of the method for calculating the ratio between the distance between the first marks M1*a* and M1*b* and the amount of deviation of the second mark M2 in the captured image. As illustrated in FIG. 18, the ratio calculator 143 obtains a distance 2D between the pair of first marks M1*a* and M1*b* in the captured image from the detected positions of the first marks M1*a* and M1*b*. Then, the ratio calculator 143 obtains a deviation amount s of the second mark M2 in the captured image based on the difference between the detected position of the second mark M2 and the ideal position of the second mark M2. In the example described here, the ideal position of the second mark M2 is the midpoint of the first marks M1*a* and M1*b*, in other words, a position away from each of the first marks M1*a* and M1*b* by half the distance between the first marks M1*a* and M1*b*. In FIG. 18, the ideal position of the second mark M2 is at a distance D (at a position indicated by broken lines in FIG. 18) equally from the first mark M1*a* and the second mark M1*b*. Then, the deviation amount s of the second mark M2 in the captured image is divided by the distance 2D between the pair of first marks M1*a* and M1*b* in the captured image, thereby calculating the ratio (s/2D). The ratio calculator 143 transmits the calculated ratio to the actual distance calculator 114.

Note that, although the ideal position of the second mark M2 is the midpoint of the pair of first marks M1*a* and M1*b* in the present embodiment, the ideal position of the second mark M2 is not limited thereto. In other words, the ideal position of the second mark M2 can be any predetermined position where the second mark M2 can be captured together with the pair of first marks M1*a* and M1*b*. The ideal position can be nearer to one of the first marks M1*a* and M1*b* or is not necessarily between the first marks M1*a* and M1*b*.

Figure 19:
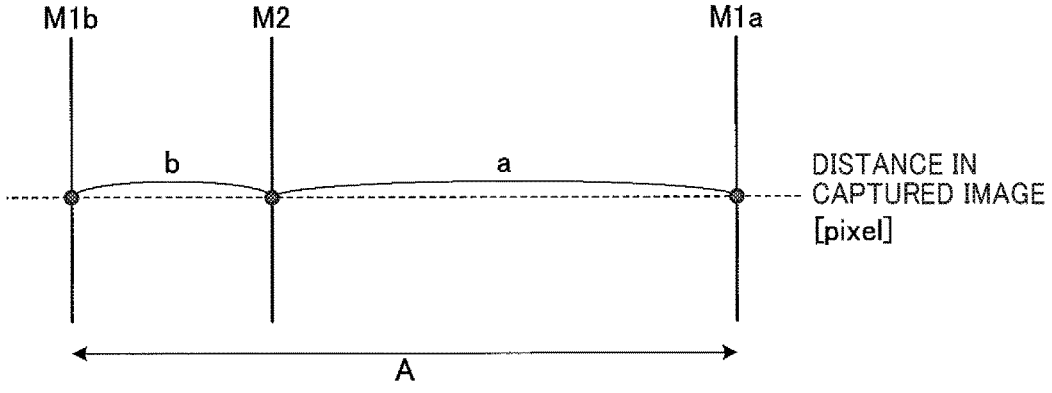
FIG. 19 is a diagram of a relative deviation between the pair of first marks and the second mark in the test pattern.

Here, a description is given of an example in which the relative positions of the pair of first marks M1*a* and M1*b* and the second mark M2 deviate in formation of the test pattern TP illustrated in FIG. 15A on the recording medium P, with reference to FIG. 19.

As described above, in the test pattern TP illustrated in FIG. 15A, the second mark M2 is expected to be located at the midpoint of the pair of first marks M1*a* and M1*b* (ideal position). However, the deviation of ink landing position caused by the difference in mark formation conditions shifts the second mark M2 closer to the first mark M1*a* as illustrated in FIG. 19. In the captured image based on this assumption, as illustrated in FIG. 19, the second mark M2 is at a distance a from the first mark M1*a* and at a distance b from the first mark M1*b*.

Even if a relative deviation between the pair of first marks M1*a* and M1*b* and the second mark M2 occurs, the actual distance between the first marks M1*a* and M1*b* is not changed because the pair of first marks M1*a* and M1*b* is formed under the same. In other words, the actual distance corresponding to a distance a+b (the distance between the first marks M1*a* and M1*b*) illustrated in FIG. 19 is not changed even if a relative deviation between the pair of first marks M1*a* and M1*b* and the second mark M2 occurs.

Figure 20:
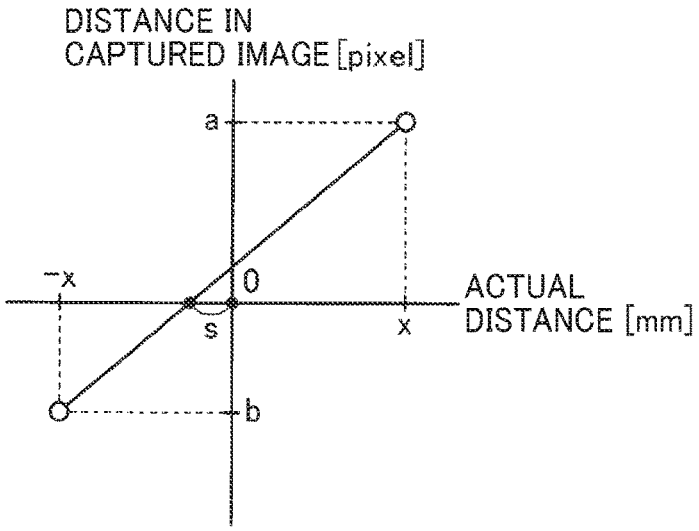
FIG. 20 is a graph of the amount of deviation of the second mark relative to the pair of first marks.

FIG. 20 is a diagram of the amount of deviation of the second mark M2 relative to the pair of first marks M1*a* and M1*b*. FIG. 20 illustrates a coordinate plane including the midpoint of the first marks M1*a* and M1*b* as an origin, the actual distance on a horizontal axis, and the distance in the captured image on a vertical axis. Each position of the first marks M1*a* and M1*b* are plotted on the coordinated plane. The example illustrated in FIG. 20 is on the assumption that the relative deviation illustrated in FIG. 19 occurs between the pair of first marks M1*a* and M1*b* and the second mark M2.

The inclination of the line connecting the plotted positions of the first marks M1*a* and M1*b* in FIG. 20 corresponds to the ratio between the distance between the first marks M1*a* and M1*b* in the captured image and the actual distance between the first marks M1*a* and M1*b*. In other words, the inclination of the line indicates the ratio between the distance in the captured image and the actual distance (image magnification). The position of the second mark M2 in the case where the relative deviation between the pair of first marks M1*a* and M1*b* and the second mark M2 does not occur is the origin. Accordingly, the distance s between the intersect of the line connecting the plotted positions of the first marks M1*a* and M1*b* and the horizontal axis and the origin represents the amount of deviation of the second mark M2 relative to the pair of first marks M1*a* and M1*b*.

The ratio between the distance in the captured image and the actual distance (the image magnification) varies according to a variation in the distance between the imaging unit 20 and the test pattern TP. The image forming apparatus 100 according to the present embodiment supports the recording medium P on which the test pattern TP is formed on the platen 16 having a rugged shape including the rib-shaped projections as described above. Thus, the rugged shape of the platen 16 varies the distance between the imaging unit 20 and the test pattern TP and may change the ratio.

Figure 21:
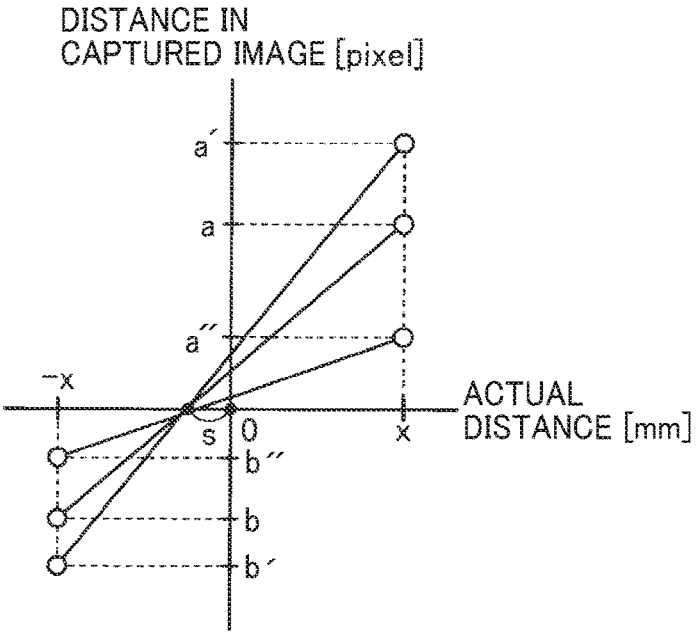
FIG. 21 is a diagram of the amount of deviation of the second mark relative to the pair of first marks when the distance between the imaging unit and the test pattern varies.

FIG. 21 is a diagram of the amount of deviation of the second mark M2 relative to the pair of first marks M1*a* and M1*b* when the distance between the imaging unit 20 and the test pattern TP varies. When the distance between the imaging unit 20 and the test pattern TP decreases, the distance between the first mark M1*a* and the second mark M2 in the captured image has a value a' larger than the distance a illustrated in FIG. 19 and the distance between the first mark M1*b* and the second mark M2 in the captured image has a value b' larger than the distance b illustrated in FIG. 19. Therefore, the inclination of the line connecting the plotted positions of the first marks M1*a* and M1*b* increases in comparison with the inclination in the example in FIG. 20.

On the other hand, when the distance between the imaging unit 20 and the test pattern TP increases, the distance between the first mark M1*a* and the second mark M2 in the captured image has a value a" smaller than the distance a illustrated in FIG. 19 and the distance between the first mark M1*b* and the second mark M2 in the captured image has a value b" smaller than the distance b illustrated in FIG. 19. Thus, the inclination of the line connecting the plotted positions of the first marks M1*a* and M1*b* decreases in comparison with the inclination in the example in FIG. 19. However, the deviation amount s of the second mark M2 from the pair of first marks M1*a* and M1*b* is not changed even if the inclination of the line connecting the plotted positions of the first marks M1*a* and M1*b* varies.

The distance between the intersect of the line connecting the plotted positions of the first marks M1*a* and M1*b* and the vertical axis and the origin is the amount of deviation of the second mark M2 relative to the pair of first marks M1*a* and M1*b* in the captured image. As the distance between the imaging unit 20 and the test pattern TP decreases, the distance between the first marks M1*a* and M1*b* increases, and the amount of deviation in the captured image also increases with the ratio. On the other hand, as the distance between the imaging unit 20 and the test pattern TP increases, the distance between the first marks M1*a* and M1*b* decreases, and the amount of deviation in the captured image also decreases at the same ratio. In other word, even if the distance between the imaging unit 20 and the test pattern TP varies, the ratio between the distance between the first marks M1*a* and M1*b* and the amount of deviation in the captured image does not change.

Referring back to FIG. 14, the actual distance calculator 114 of the CPU 110 multiplies the distance between the theoretical distance (actual distance) between the first marks M1*a* and M1*b* by the ratio calculated with the ratio calculator 143, thereby calculating the actual distance of deviation amount s of the second mark M2, relative to the pair of first marks M1*a* and M1*b*. The actual distance calculator 114 transmits the calculated actual distance to the adjusting unit 115. The theoretical distance (actual distance) between the first marks M1*a* and M1*b* is the distance by which the carriage 5 moves from formation of the first mark M1*a* to formation of the first mark M1*b*, controlled by the pattern forming unit 111 of the CPU 110, that is, instructed in the pattern data.

The adjusting unit 115 of the CPU 110 calculates the correction amount of the parameter relating to the position of image formation by the image forming device, based on the actual distance of the deviation amount s of the second mark M2 calculated by the actual distance calculator 114. Then, the adjusting unit 115 adjusts the parameter by the calculated correction amount. The parameter relating to the position of image formation includes a parameter to control the timing of discharge of ink from the recording head 6 and a parameter to control the speed of travel of the carriage 5. The adjusting unit 115 transmits the adjustment values for the parameters to the control FPGA 120 in order to adjust, for example, operations of the ink discharge controller 123 and the motor controller 125.

[Operation of Image Forming Apparatus]

Figure 22A:
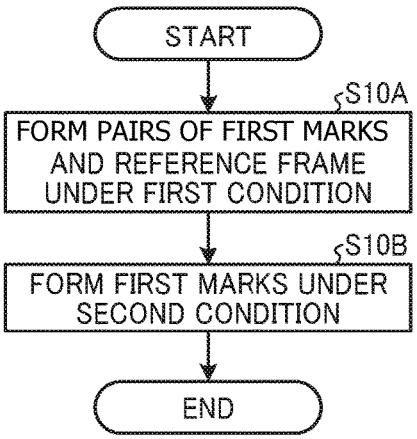
FIG. 22A is a flowchart of operation for adjustment of image formation position in the image forming apparatus according to Embodiment 1.
Figure 22B:
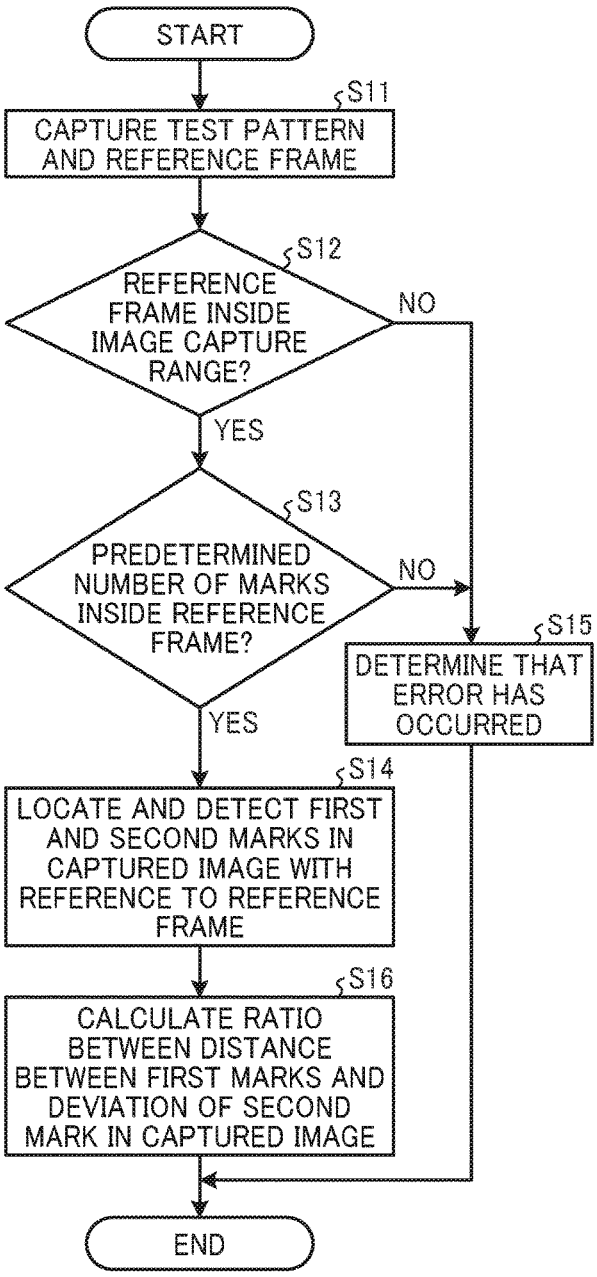
FIG. 22B is a flowchart of operation for adjustment of image formation position in the imaging unit according to Embodiment 1.
Figure 22C:
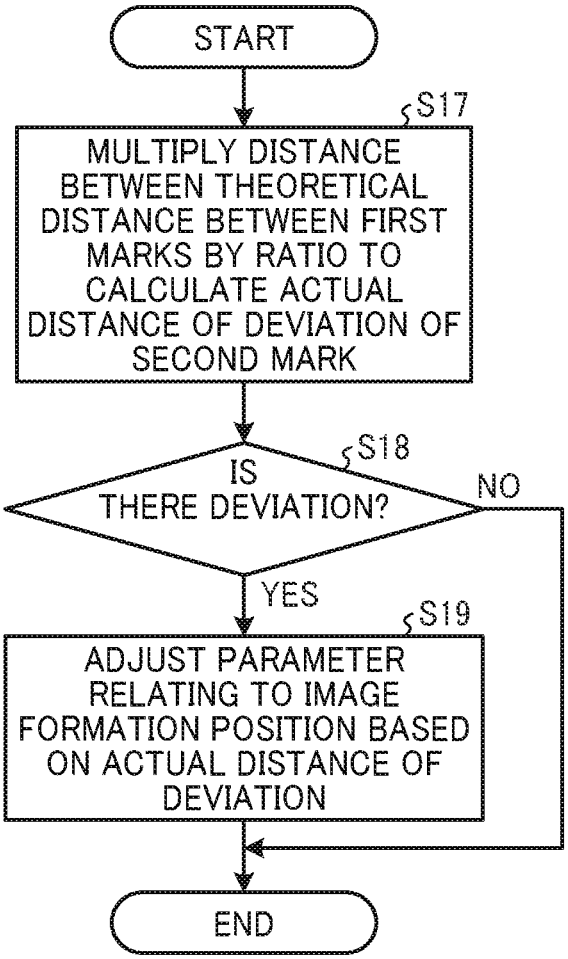
FIG. 22C is a flowchart of operation for adjustment of image formation position in the image forming apparatus according to Embodiment 1.

Referring to FIGS. 22A, 22B, and 22C, descriptions are given of the operation of the image forming apparatus 100 for adjusting the image formation position, according to Embodiment 1. FIGS. 22A and 22C are flowcharts of operation of the CPU 110 of the main control board 130, and FIG. 22B is a flowchart of operation of the two-dimensional sensor CPU 140 of the imaging unit 20, of the operation relating to adjustment of image formation position.

Referring to FIG. 22A, when the recording medium P is set on the platen 16, the pattern forming unit 111 of the CPU 110 on the main control board 130 causes the image forming device described above to perform image formation, according to the pattern data retrieved from the ROM 102 or the like, to form the test pattern TP and the reference frame F. Specifically, at S10A, the pattern forming unit 111 causes the image forming device to form, on the recording medium P, the pairs of first marks M1*a* and M1*b* of the test pattern TP and the reference frame F under the first direction and, at S10B, causes the image forming device to form the plurality of second marks M2 under the second condition. For example, in the second condition, the direction of travel of the carriage 5 is different from the first direction.

Referring to FIG. 22B, at S11, the two-dimensional sensor 27 of the imaging unit 20 captures an image of the test pattern TP and the reference frame F formed at steps S10A and 10B under control of the pattern forming unit 111 of the CPU 110, and outputs the captured image including the test pattern TP and the reference frame F.

At S12, the position detector 142 of the two-dimensional sensor CPU 140 analyzes the test pattern TP and the reference frame F in the image captured and output at S11 and determines whether or not the reference frame F is located inside the captured range.

When the captured range includes the reference frame F (Yes at S12), at S13, the position detector 142 identifies the reference frame F and determines whether or not the reference frame F surrounds a predetermined number of marks of the test pattern TP. When the number of the marks inside the reference frame F matches the predetermined number (Yes at S13), at S14, the position detector 142 locates and detects the first marks M1*a* and M1*b* and the second mark M2 based on the reference frame F in the captured image.

By contrast, when the captured range does not include the reference frame F (No at S12), or the reference frame F does not include the predetermined number of marks (No at S13), at S15 the position detector 142 determines that an error has occurred in the processing and ends the processing.

At S16, the ratio calculator 143 of the two-dimensional sensor CPU 140 calculates the ratio between the amount of deviation of the second mark M2 in the captured image and the distance between the first marks M1*a* and M1*b* in the captured image, using the detected positions of the pair of first marks M1*a* and M1*b* and the second mark M2 in the captured image. For example, the mark sets M are different in color, and the processing at S16 is performed regarding each of the mark sets M, thereby calculating the ratio for each of the different colors.

Referring to FIG. 22C, at S17, the actual distance calculator 114 of the CPU 110 multiplies, with the ratio, the actual distance between the first marks M1*a* and M1*b*, using the pattern data used to form the test pattern TP at steps S10A and S10B and the ratio calculated at step S16 by the ratio calculator 143 of the two-dimensional sensor CPU 140, to calculate the actual distance of the deviation of the second mark M2.

At S18, the adjusting unit 115 of the CPU 110 determines, based on the actual distance of deviation of the second mark M2 calculated at step S17, whether the landing position of ink has deviated. When the adjusting unit 115 determines that the landing position of ink has not deviated (No at S18), a sequence of operations is completed.

On the other hand, when the adjusting unit 115 determines that the landing position has deviated (Yes at S18), at S19, the adjusting unit 115 calculates the correction amount of the parameter relating to the position of image formation based on the actual distance of the deviation of the second mark M2 calculated at S17. Then, a sequence of processing ends.

Any one of the above-described operations may be performed in various other ways, for example, in an order different from the one described above.

As described above, the image forming apparatus 100 according to the present embodiment forms the test pattern TP and the reference frame F. The test pattern TP includes the pair of first marks M1*a* and M1*b* and the second mark M2 formed under a condition different from the condition under which the first marks M1*a* and M1*b* is formed. The imaging unit 20 captures the test pattern TP and the reference frame F. Next, the position detector 142 of the two-dimensional sensor CPU 140 identifies the reference frame F in the captured image and, with reference to the reference frame F, locates and detects the pair of first marks M1*a* and M1*b* and the second mark M2 of the test pattern TP. Then, the image forming apparatus 100 calculates the ratio between the distance between the first marks M1*a* and M1*b* in the captured image and the amount of deviation of the second mark M2 in the captured image, and multiplies the actual distance between the first marks M1*a* and M1*b* by the ratio to calculate the actual distance of deviation of the second mark M2. Then, the image forming apparatus 100 adjusts the parameter relating to the position of image formation based on the actual distance of the deviation.

Therefore, according to the present embodiment, even if the distance between the imaging unit 20 and the test pattern TP varies, the image forming apparatus 100 can calculate the actual distance of deviation of the landing position of ink based on the captured image including the test pattern TP and the reference frame F. Then, the image forming apparatus 100 can adjust the parameter relating to position of image formation based on the amount of deviation, thereby improving the image quality. The reference frame F is identified from the image taken by the imaging unit 20, and the pair of first marks M1*a* and M1*b* and the second mark M2 are located with reference to the reference frame F. Accordingly, locating the test pattern TP in the captured image can be easy.

[Another Method for Calculating Actual Distance of Deviation of Second Mark]

In the embodiment described above, the ratio between the distance between the first marks M1*a* and M1*b* in the captured image and the amount of deviation of the second mark M2 in the captured image is calculated. Then, the actual distance between the first marks M1*a* and M1*b* is multiplied by the calculated ratio to obtain the actual distance of deviation of the second mark M2. Alternatively, the following method can be used to calculate the actual distance of deviation of the second mark M2.

The ratio calculator 143 calculates the ratio between the distance between the first marks M1*a* and M1*b* in the captured image and the distance between one of the first marks M1*a* and M1*b* and the second mark M2 in the captured image. For example, when FIG. 19 is referred to, the calculated ratio in this example is represented as a/(a+b) or b/(a+b).

Then, the actual distance calculator 114 multiplies the actual distance between the first marks M1*a* and M1*b* by the ratio calculated with the ratio calculator 143 to calculate the actual distance between one of the first marks M1*a* and M1*b* and the second mark M2. Then, the actual distance calculator 114 subtracts the calculated actual distance between one of the first marks M1*a* and M1*b* and the second mark M2 from the distance between one of the first marks M1*a* and M1*b* and the second mark M2 in the pattern data used to form the test pattern TP in order to calculate the actual distance of deviation of the second mark M2. Then, the image forming apparatus 100 adjusts the parameter relating to the position of image formation based on the actual distance of the deviation of the second mark M2.

[Modification of Test Pattern]

The test pattern TP used in the present embodiment is not limited to the example illustrated in FIG. 15A and can be variously modified. A modification of the test pattern TP will be described below.

Figure 23:
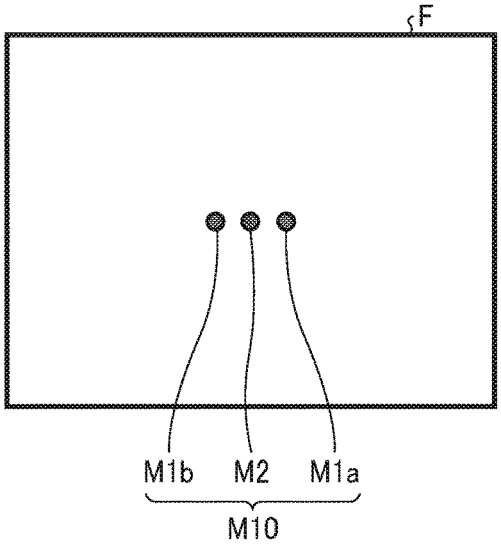
FIG. 23 illustrates an example of a test pattern formed with dots and a reference frame, according to an embodiment.

In the test pattern TP illustrated in FIG. 15A, the pair of first marks M1*a* and M1*b* and the second mark M2 are lines extending in the sub-scanning direction B. Alternatively, the marks can be dots when there is no effect of nozzle bend or the effect of nozzle bend is small and ignorable. FIG. 23 illustrates an example of a test pattern formed with dots and the reference frame F. For example, as illustrated in FIG. 23, a mark set M10 formed with dots is disposed inside the reference frame F. The mark set M10 includes a pair of dots serving as the pair of first marks M1*a* and M1*b* and a dot serving as the second mark M2 disposed at a midpoint of the first marks M1*a* and M1*b*.

Figure 24:
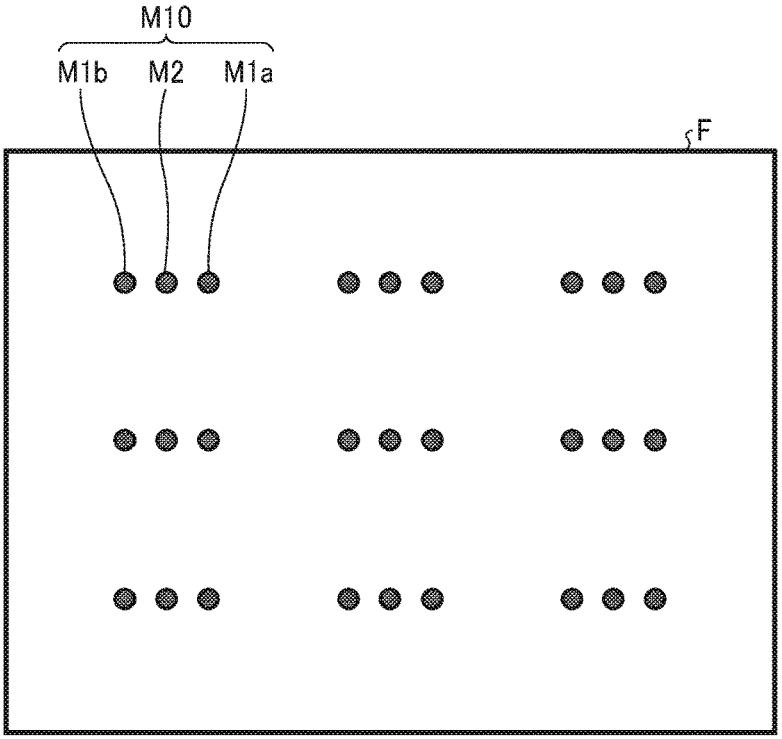
FIG. 24 illustrates another example of the test pattern formed with dots and the reference frame.

FIG. 24 illustrates another example of the test pattern formed with dots and the reference frame F. In FIG. 24, a plurality of mark sets M10 is formed inside the reference frame F, and each mark set M10 includes the pair of dots serving as the pair of first marks M1*a* and M1*b* and a dot serving as the second mark M2 disposed at a midpoint of the first marks M1*a* and M1*b*. The test pattern illustrated in FIG. 24 includes nine mark sets M10.

Figure 25:
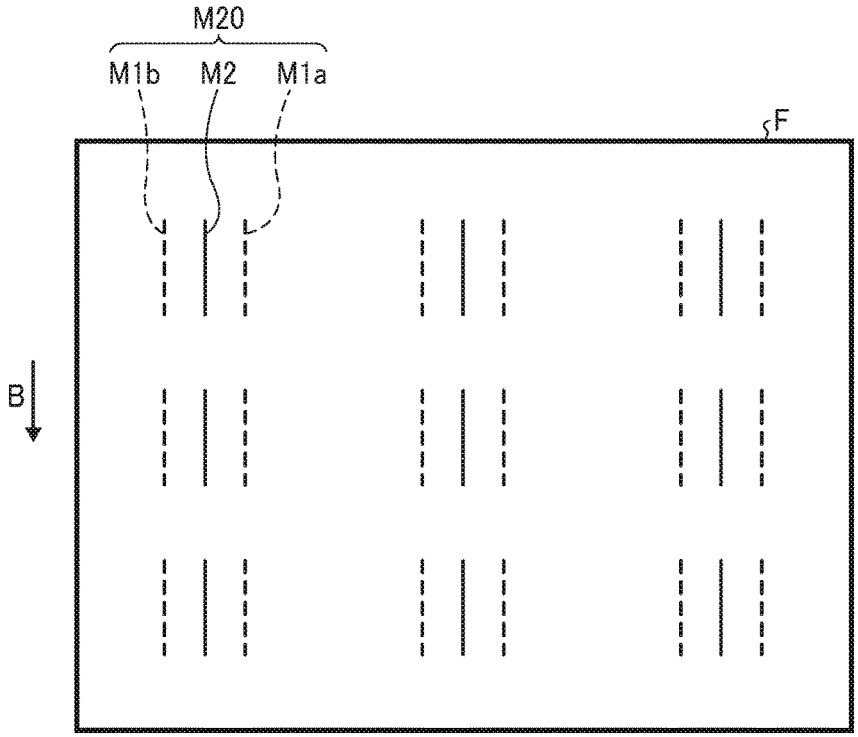
FIG. 25 illustrates one example of a test pattern formed with lines having a predetermined length and the reference frame, according to an embodiment.

Further, in the test pattern TP illustrated in FIGS. 15A and 15B, the pair of first marks M1*a* and M1*b* and the second mark M2 are lines longer than the reference frame F in the sub-scanning direction B. Alternatively, the marks can have a predetermined length shorter than the reference frame F in the sub-scanning direction B when there is no effect of nozzle bend or the effect of nozzle bend is small and ignorable. FIG. 25 illustrates one example of a test pattern formed with lines having a predetermined length and the reference frame F. In FIG. 25, a plurality of mark sets M20 is formed inside the reference frame F. Each mark set M20 includes the pair of linear first marks M1*a* and M1*b* having a predetermined length, and the linear second mark M2 disposed at a midpoint of the first marks M1*a* and M1*b*. The length of the second mark M2 is identical to the length of the first marks M1*a* and M1*b*. The test pattern illustrated in FIG. 25 includes nine mark sets M20.

Figure 26:
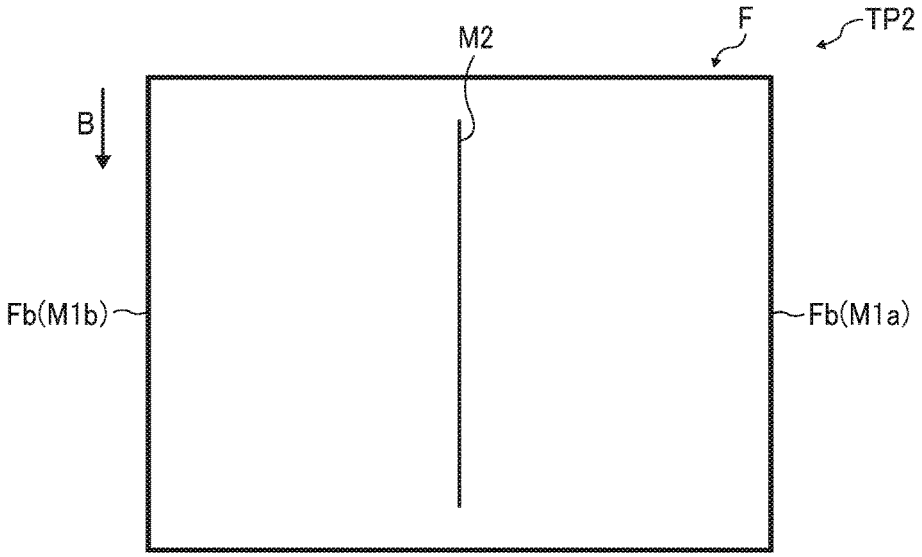
FIG. 26 illustrates an example of a test pattern including a portion formed by a reference frame, according to an embodiment.

Additionally, in the test pattern TP illustrated in FIG. 15A, the mark set M includes the first marks M1*a* and M1*b* and the second mark M2 positioned inside the reference frame F. Alternatively, the reference frame F can double as a portion of the test pattern TP as illustrated in FIG. 26. For example, the reference frame F can double as the pair of first marks M1*a* and M1*b*. Specifically, in a test pattern TP2 illustrated in FIG. 26, the pair of reference lines Fb of the reference frame F extending in the sub-scanning direction B doubles as the pair of first marks M1*a* and M1*b*, and the second mark M2 is disposed between the reference lines Fb. The reference lines Fa extending in the main scanning direction Fa serves as reference marks. In this configuration, the test pattern TP2 can be detected together with detection of the reference frame F.

Figure 27:
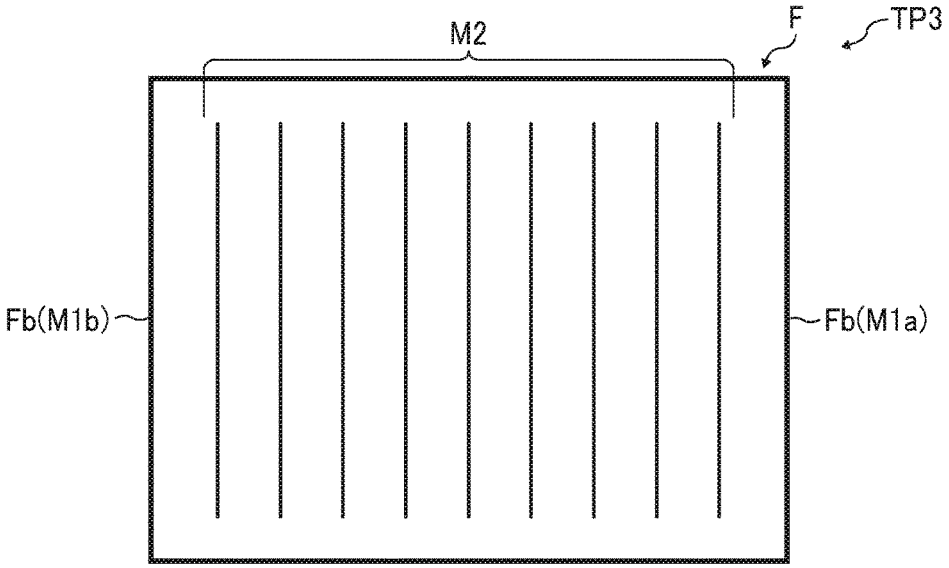
FIG. 27 illustrates another example of the test pattern including a portion formed by the reference frame.

FIG. 27 illustrates another example in which the reference frame F doubles as a portion of the test pattern. Specifically, in a test pattern TP3 illustrated in FIG. 27, the pair of reference lines Fb of the reference frame F extending in the sub-scanning direction B doubles as the pair of first marks M1*a* and M1*b*, and a plurality of second marks M2 is disposed between the reference lines Fb. In FIG. 27, nine second marks M2 are disposed. In this configuration, the test pattern TP3 can be detected together with detection of the reference frame F.

[Identifying Reference Frame]

Figure 28A:
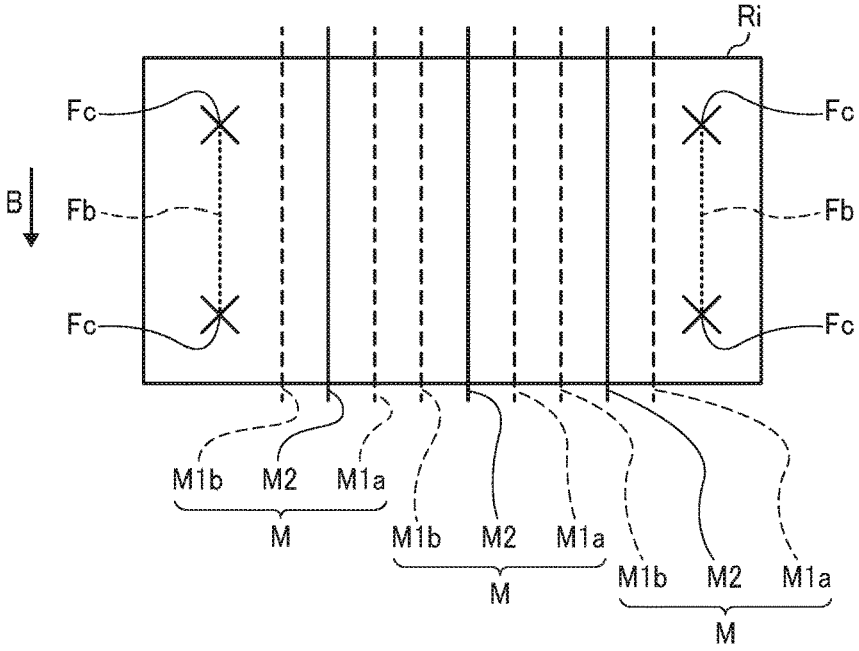
FIG. 28A illustrates a method of virtually identifying a reference line from a reference position, according to an embodiment.
Figure 28B:
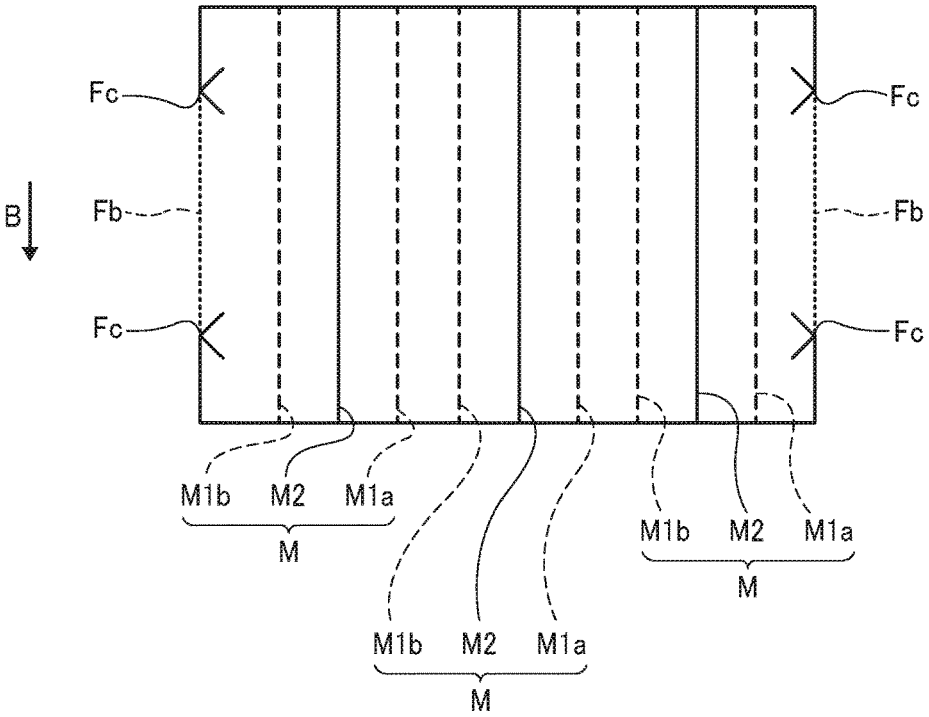
FIG. 28B is an example image trimmed along the virtually identified reference line, according to an embodiment.

Although the description above concerns an example in which the reference lines Fb are formed together with the pair of first marks M1*a* and M1*b*, alternatively, a plurality of reference positions marks can be formed to identify the reference lines Fb. FIG. 28A illustrates a method of virtually identifying the reference lines Fb from reference position marks. FIG. 28B is an example image trimmed along the virtually identified reference lined Fb.

For example, in FIG. 28A, two pairs of reference position marks Fc are formed, and each pair of reference position marks Fc is lined up in the sub-scanning direction B. In FIG. 28A, the reference position mark Fc is illustrated like a multiplication symbol (×). The two reference position marks Fc in each pair are virtually connected together to virtually identify the reference lines Fb, and the magnification of the captured image can be adjusted.

In FIG. 28B, for example, the captured image is trimmed along the virtual reference lines Fb. For example, the two-dimensional sensor CPU 140 magnifies the image to adjust the width of the trimmed image to a predetermined width and then locates the pair of first marks M1*a* and M1*b* positioned at a predetermined distance from an end of the trimmed image, that is, the virtual reference line Fb. Then, the two-dimensional sensor CPU 140 locates and detects the second mark M2 positioned between the first marks M1*a* and M1*b*.

Embodiment 2

Although, in the image forming apparatus according to Embodiment 1, the two-dimensional sensor CPU mounted on the carriage performs the position detection of the test pattern in the captured image and the ratio calculation, alternatively, the main control board can perform the position detection and ratio calculation.

Figure 29:
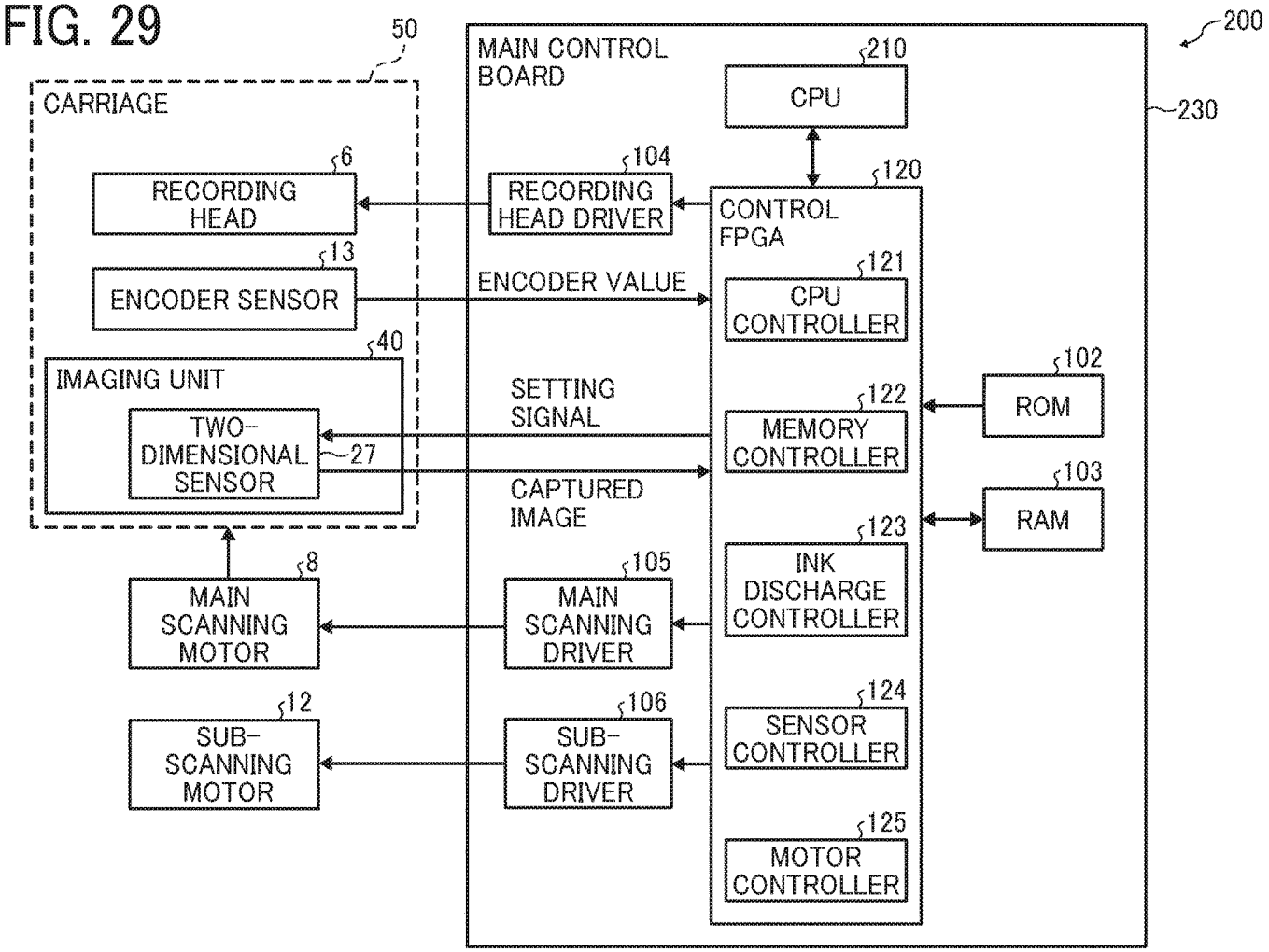
FIG. 29 is a block diagram of a hardware configuration of an image forming apparatus according to Embodiment 2.

A hardware configuration of an image forming apparatus 200 according to the present embodiment will be described referring to FIG. 29. FIG. 29 is a block diagram of the hardware configuration of the image forming apparatus according to Embodiment 2.

As illustrated in FIG. 29, the image forming apparatus 200 according to the present embodiment includes a central processing unit (CPU) 210, the read-only memory (ROM) 102, the random access memory (RAM) 103, the recording head driver 104, the main scanning driver 105, the sub-scanning driver 106, the control Field-Programmable Gate Array (FPGA) 120, the recording head 6, the encoder sensor 13, an imaging unit 40, the main scanning motor 8, and the sub-scanning motor 12.

The CPU 210, the ROM 102, the RAM 103, the recording head driver 104, the main scanning driver 105, the sub-scanning driver 106, and the control FPGA 120 are mounted on a main control board 230. Meanwhile, the recording head 6, the encoder sensor 13, and the imaging unit 40 are mounted on a carriage 50.

Configurations except the central processing unit (CPU) 210 and the imaging unit 40 are similar to those of Embodiment 1, and thus redundant descriptions are omitted.

Similar to Embodiment 1, the CPU 210 controls the entire image forming apparatus 200. In particular, the image forming apparatus 200 according to the present embodiment uses the CPU 210 to implement, for example, a function to form the test pattern TP and the reference frame F (illustrated in FIG. 15A) to locate the test pattern TP, a function to measure distance, and a function to adjust a parameter relating to the position of image formation based on the distance.

The imaging unit 40 includes the two-dimensional sensor 27 and captures an image of the test pattern TP (see FIG. 15A) and the reference frame F on the recording medium P, controlled by the CPU 210.

The two-dimensional sensor 27 is, for example, a CCD sensor or a CMOS sensor as described above. The two-dimensional sensor 27 captures an image of the test pattern TP and the reference frame F under predetermined operation conditions according to various setting signals transmitted via the control FPGA 120 from the CPU 210. Then, the two-dimensional sensor 27 transmits the captured image via the control FPGA 120 to the CPU 210.

Figure 30:
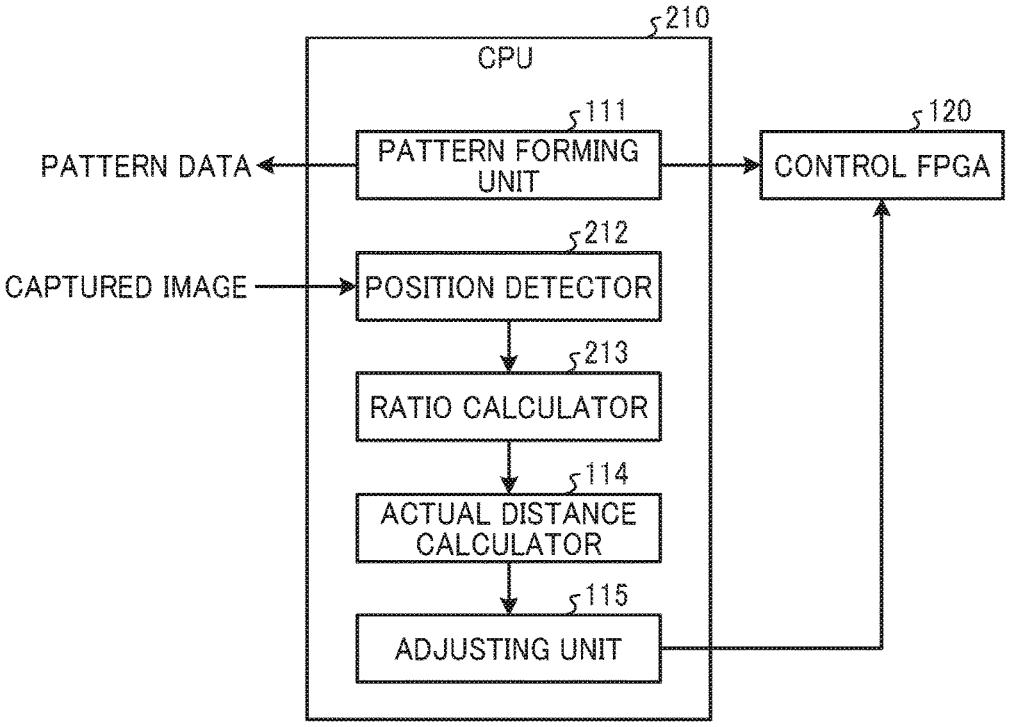
FIG. 30 is a block diagram of a functional configuration of the image forming apparatus according to Embodiment 2.

Referring to FIG. 30, characteristic functions implemented by the CPU 210 of the image forming apparatus 200 will be described. FIG. 30 is a block diagram of a functional configuration of the image forming apparatus according to Embodiment 2.

For example, the CPU 210 uses the RAM 103 as a work area to execute a control program stored on the ROM 102 in order to implement, the functions of the pattern forming unit 111, a position detector 212, a ratio calculator 213, the actual distance calculator 114, the adjusting unit 115, and the like.

Functions of the pattern forming unit 111, the actual distance calculator 114, and the adjusting unit 115 are similar to those of Embodiment 1, and thus redundant descriptions are omitted.

Although functions of the position detector 212 and the ratio calculator 213 are similar to those of the position detector 142 and the ratio calculator 143 of Embodiment 1, the position detector 212 and the ratio calculator 213 are implement in the CPU 210, differently from Embodiment 1.

In the image forming apparatus 200 according to Embodiment 2, the sequence of actions relating to adjustment of the image formation position is similar to that in Embodiment 1 (see FIGS. 22A to 22C), and thus redundant descriptions are omitted.

Thus, in the image forming apparatus 200 according to the present embodiment, the CPU 210 of the main control board 230 performs all of the functions including the position detector 212 and the ratio calculator 213. This configuration attains the effects similar to those attained by the image forming apparatus 100 according to Embodiment 1.

The description above concerns calculating the amount of deviation in the landing position of ink caused by the difference between the forward travel of the carriage and the backward travel of the carriage, using the test pattern TP and the reference frame F and adjusting the parameter relating to the position of image formation. Alternatively, aspects of this disclosure can adapt to calculation of the amount of deviation caused by an error in conveyance of the recording medium P or error in attachment of the recording heads.

For example, when the aspects of this disclosure are applied to calculation of deviation caused by an error in conveyance of the recording medium P, the test pattern is formed as follows. Before the recording medium P is conveyed, the pair of first marks M1*a* and M1*b* is formed as a pair of lines extending in the main scanning direction A (perpendicular to the sub-scanning direction B in which the recording medium P is conveyed). After the recording medium P is conveyed, the second mark M2 is formed as a line extending in the main scanning direction A (perpendicular to the sub-scanning direction B). The reference frame F is formed together with either the pair of first marks M1*a* and M1*b* or the second mark M2, similar to Embodiment 1. In this case, the difference in the conditions of formation the pair of first marks M1*a* and M1*b* and the second mark M2 is that whether the formation is before or after conveyance of the recording medium P.

Alternatively, when the aspects of this disclosure are applied to calculation of deviation caused by an error in attachment of the recording heads, the test pattern is formed as follows. With a first recording head, the pair of first marks M1*a* and M1*b* is formed as a pair of lines extending in the main scanning direction A (perpendicular to the sub-scanning direction B in which the recording medium P is conveyed). With a second recording head different from the first recording head, the second mark M2 is formed as a line extending in the main scanning direction A (perpendicular to the sub-scanning direction B). The reference frame F is formed together with either the pair of first marks M1*a* and M1*b* or the second mark M2, similar to Embodiment 1. In this case, the difference in the conditions of formation the pair of first marks M1*a* and M1*b* and second mark M2 is that the recording head used in different.

Note that the computer programs performed in the image forming apparatus according to the above-described embodiments are preliminarily installed in a memory device such as a read only memory (ROM). Alternatively, the computer programs executed in the image forming apparatus according to the above-described embodiments can be provided as files being in an installable format or an executable format and stored in a computer-readable recording medium, such as a compact disc read only memory (CD-ROM), a flexible disk (FD), a compact disc recordable (CD-R), and a digital versatile disk (DVD).

Alternatively, the computer programs executed in the image forming apparatus according the above-described embodiments can be stored in a computer connected to a network such as the Internet and downloaded through the network. Alternatively, the computer programs executed in the image forming apparatus can be supplied or distributed via a network such as the Internet.

Programs executed in the image forming apparatus according to the above-described embodiment are in the form of module including the above-described functional units (the pattern forming unit, the position detector, the ratio calculator, the actual distance calculator, and the adjusting unit). As the CPU (a processor) reads out the program from the ROM and executes the program, the above-described functional units are loaded and implemented (generated), as hardware, in a main memory. Alternatively, for example, a portion or all of the above-described functions can be implemented by a dedicated hardware circuit.

The above-described embodiments are illustrative and do not limit the present invention.

For example, although the image forming apparatus described above is a serial head inkjet printer, aspects of this disclosure are applicable to a variety of image forming apparatuses. For example, in a line head inkjet printer, misalignment between recording heads can cause deviations in the landing position of ink. Applying aspects of this disclosure enables accurate calculation of the deviation amount and adjustment of parameter relating to position of image formation in accordance with the deviation amount, thereby improving the image quality.

Additionally, for example, in a tandem electrophotographic image forming apparatus, misalignment between photoconductor drums can cause a deviation of image position equivalent to deviations in the landing position of ink in an inkjet printer. Applying aspects of this disclosure enables accurate calculation of the deviation amount of the image in the event of the image position deviation and adjustment of parameter relating to position of image formation in accordance with the deviation amount, thereby improving the image quality.

Additionally, for example, in a thermal printer to perform printing on a recording medium with heat, misalignment or deviation of a thermal head can cause a positional deviation of an image equivalent to deviations in the landing position of ink in an inkjet printer. Applying aspects of this disclosure enables accurate calculation of the deviation amount of the image in the event of the image position deviation and adjustment of parameter relating to position of image formation in accordance with the deviation amount, thereby improving the image quality.

Image formation according to this disclosure includes, in addition to output on recording media such as sheets, formation of boards. Although the image forming apparatus according to the above-described embodiment is a printer, aspects of this disclosure are applicable to other type image forming apparatuses such as copiers and multifunction peripherals (MFPs) having at least two of copying, printing, scanning, and facsimile transmission capabilities.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An imaging device comprising:

an imaging unit to obtain a captured image of a test pattern and a reference mark to locate the test pattern, the test pattern including a pair of first marks and a second mark; and at least one processor including:

a position detector configured to detect the reference mark in the captured image and locate the pair of first marks and the second mark in the captured image with reference to the reference mark;

a ratio calculator configured to calculate one of:

a first ratio between a distance between the pair of first marks in the captured image and a deviation of the second mark in the captured image from an ideal position, and a second ratio between the distance between the pair of first marks in the captured image and a distance from one of the pair of first marks to the second mark in the captured image; and an adjusting unit configured to adjust a parameter relating to image formation based on the first ratio or the second ratio.

2. The imaging device according to claim 1, wherein the reference mark includes a pair of reference lines between which the test pattern is interposed, and wherein the position detector is configured to detect the pair of reference lines and locate and detect the pair of first marks and the second mark between the pair of reference lines.

3. The imaging device according to claim 1, wherein the pair of first marks and the second mark are lines extending in a predetermined direction, and wherein the reference mark includes a reference line extending in the predetermined direction.

4. The imaging device according to claim 3, wherein the predetermined direction is a direction of conveyance of a recording medium on which the test pattern is formed.

5. The imaging device according to claim 4, wherein an image capture range of the imaging unit is shorter than each of the pair of first marks and the second mark in the direction of conveyance of the recording medium.

6. The imaging device according to claim 1, wherein the reference mark includes a reference frame surrounding a predetermined area smaller than an image capture range of the imaging device, and wherein the position detector is configured to detect the reference frame and locate and detect the pair of first marks and the second mark inside the reference frame.

7. An image forming apparatus comprising:

an image forming device to form a test pattern and a reference mark to locate the test pattern, the test pattern including a pair of first marks and a second mark;

an imaging unit to obtain a captured image including the test pattern and the reference mark; and at least one processor including:

a pattern forming unit configured to cause the image forming device to form the pair of first marks under a first condition, form the second mark under a second condition different from the first condition, and form the reference mark together with one of the pair of first marks and the second mark, a position detector configured to detect the reference mark in the captured image and locate the pair of first marks and the second mark in the captured image with reference to the reference mark;

a distance calculator configured to calculate an actual distance of a deviation of the second mark from an ideal position based on a distance between the pair of first marks in the captured image, a position of the second mark in the captured image, and a theoretical distance between the pair of first marks; and an adjusting unit configured to adjust a parameter relating to a position of image formation by the image forming device based on the actual distance of the deviation of the second mark.

8. A method comprising:

obtaining a captured image of a test pattern and a reference mark to locate the test pattern, the test pattern including a pair of first marks and a second mark, detecting the reference mark in the captured image, locating the pair of first marks and the second mark in the captured image with reference to the reference mark;

calculating one of:

a first ratio between a distance between the pair of first marks in the captured image and a deviation of the second mark in the captured image from an ideal position, and a second ratio between the distance between the pair of first marks in the captured image and a distance from one of the pair of first marks to the second mark in the captured image; and adjusting a parameter relating to image formation based on the first ratio or the second ratio.

9. The method according to claim 8, further comprising:

forming the pair of first marks under a first condition;

forming the second mark under a second condition different from the first condition; and forming the reference mark together with one of the pair of first marks and the second mark.

10. The method according to claim 8, further comprising calculating an actual distance of the deviation of the second mark, based on the distance between the pair of first marks in the captured image, a position of the second mark in the captured image, and a theoretical distance between the pair of first marks.

* * * * *